US007008163B2

(12) United States Patent
Russell

(10) Patent No.: US 7,008,163 B2
(45) Date of Patent: Mar. 7, 2006

(54) BULK STORAGE BINS AND METHODS AND APPARATUS FOR UNLOADING SAME

(76) Inventor: Matthew Russell, 4408 W. Elderberry St., Spokane, WA (US) 99208

( * ) Notice: Subject to any disclaimer, the term of this patent is extended or adjusted under 35 U.S.C. 154(b) by 16 days.

(21) Appl. No.: 10/372,492

(22) Filed: Feb. 21, 2003

(65) Prior Publication Data

US 2003/0156929 A1 Aug. 21, 2003

Related U.S. Application Data

(60) Provisional application No. 60/358,666, filed on Feb. 21, 2002.

(51) Int. Cl.
*B65G 1/00* (2006.01)

(52) U.S. Cl. ..... 414/306; 414/318; 414/328; 414/216

(58) Field of Classification Search ..... 414/306, 414/318, 328, 216, 414, 519, 520
See application file for complete search history.

(56) References Cited

U.S. PATENT DOCUMENTS 2,505,982 A * 5/1950 Meissner ..... 414/142.3
2,815,134 A * 12/1957 Borrowdale ..... 198/533
3,191,998 A * 6/1965 Howlett ..... 406/53
4,226,566 A * 10/1980 Maust ..... 414/519
4,249,845 A * 2/1981 Teske ..... 414/133
4,311,426 A * 1/1982 Teske ..... 414/133
4,428,504 A * 1/1984 Bassett et al. ..... 222/55
4,457,660 A * 7/1984 Pippinger ..... 414/332
4,568,237 A * 2/1986 Krause et al. ..... 414/519
4,828,448 A * 5/1989 Skeath ..... 414/304
4,925,356 A * 5/1990 Snead et al. ..... 414/339
5,702,221 A * 12/1997 Sridhar ..... 414/142.3
5,823,734 A * 10/1998 Hagemeyer et al. ..... 414/519
6,126,375 A * 10/2000 O'Brien ..... 414/299
6,146,080 A * 11/2000 Sinke ..... 414/519
6,676,357 B1 * 1/2004 Stafford et al. ..... 414/306

* cited by examiner

*Primary Examiner*—Gene O. Crawford
*Assistant Examiner*—Rashmi Sharma
(74) *Attorney, Agent, or Firm*—John S. Reid

(57) ABSTRACT

One embodiment provides for a material reclaiming apparatus for use with a bulk storage bin. The bulk storage bin includes a bottom which defines an elongated plurality of outlet openings from the storage bin. The material reclaiming apparatus includes a plurality of gates. Each gate is associated with a respective outlet opening, and each gate is moveable from a first position (blocking the associated outlet opening), to a second position (not blocking the associated outlet opening). The material reclaiming apparatus further includes a traveling reclaimer located beneath the bottom of the bulk storage bin, and which is configured to travel along the bottom beneath the gates. The traveling reclaimer includes a gate actuator. As a result of positioning the traveling reclaimer under any given gate, the gate actuator engages the gate to allow the gate actuator to move the gate from the first position to the second position.

18 Claims, 13 Drawing Sheets

BULK STORAGE BINS AND METHODS AND APPARATUS FOR UNLOADING SAME

CROSS REFERENCE TO RELATED APPLICATIONS

The present application claims priority under 35 U.S.C. § 120 to U.S. Provisional Patent Application Ser. No. 60/358,666, filed Feb. 21, 2002 and entitled, "Traveling Reclaimer with Gate Actuator applied to Corrugated Modular Bin", which is hereby incorporated herein by reference in its entirety.

FIELD OF THE INVENTION

The invention claimed and disclosed herein pertains to bulk storage bins other and bulk storage means, and methods and apparatus for unloading such bulk storage means.

BACKGROUND

This invention pertains to bulk storage bins, such as are commonly used to store bulk materials such as coal, ores, grain, coke and cement, for example. The invention further pertains to other bulk storage means, and methods and apparatus for recovering (or "reclaiming" bulk materials from such bulk storage means. Such bulk storage bins (and other bulk storage means) can be located on a ground site, or in the hold of a ship, for example.

There is a multitude of prior art for the storage of free-flowing bulk materials including principally: (1) bins, (2) bunkers, (3) silos, (4) domes, (5) barns, (6) highwalls, and (7) open stockpiles. The following background discussion centers on these principal types of bulk storage means within the context of how the particular structure or means is constructed, how the structure or means is compartmentalized to accept a variety of bulk materials, and how the bulk materials are reclaimed from the structure or means.

Prior art methods and/or apparatus for storing bulk solids include the use of (1) bins, (2) bunkers, (3) silos, (4) domes, (5) barns, (6) highwalls, and (7) open stockpiles. Each such storage means will now be generally described, and well as methods and/or apparatus that are commonly used to remove (i.e., "reclaiming") the bulk solid from the storage means.

Bins are typically steel and/or reinforced concrete rectangular or square holding vessels that are relatively short in height compared to their plan dimensions. Bins are typically emptied of their bulk materials by means of gravity feed through a single bin hopper and single gated discharge opening at the bottom center of the bin. Bins walls are typically constructed of steel panels or of straight, cast-in-place (or precast) reinforced concrete walls of a specified thickness. Hydrostatic material forces are typically taken in beam action horizontally between the four corners of the bin, the steel or concrete wall sections being appropriately stiffened with reinforcement and stiffener beams. To provide for a variety of bulk materials, multiple bins are typically constructed in a row to make use of a single, stationary (i.e., fixed-in-place) discharge conveyor which is located underneath the bins. Each discharge point has a designated mechanical means of actuating the reclaim gate to an "open" or "closed" position and, in most cases, to a degree in-between these extreme positions, to thereby effect a metering of the bulk material flow. There can also be a feeder (e.g., conveyor type, vibratory type, or auger type, among others) below the gate or hopper opening to affect a metered flow of material onto the reclaim conveyor, or into trucks or trains or other mediums of conveyance. Discharge or draw-points are typically spaced apart at intervals under a continuum bin structure.

Bunkers are similar to bins but are typically 3-sided instead of 4-sided, and are typically a retaining wall type structure, and are emptied of bulk material via a tunnel reclaim system under the bunker. Allowance for multiple bulk materials is made by constructing multiple bunkers. The reclaim systems typically used for bunkers are similar to those used for bins.

Silos are typically relatively tall steel or reinforced concrete cylinders cast or assembled as a separate unit, or within the context of a pack of closely spaced or integrally cast cylinders. Cast-in-place silos can be cast with jump-form or slip-form systems. Reclaim of the bulk solids from silos is typically achieved by funnel flow or mass flow in the silo based on the angle of a conical hopper at the base of the silo. Large diameter silos typically have multiple, in-line draw points. Each draw point is typically equipped in a similar fashion to those on the bins with flow metering devices, most typically including vibratory feeders or augers and/or actuatable gates.

Domes are constructed as a hemisphere (i.e., no material is stacked against the shell) or super-sphere (i.e., material can be stacked against the shell) structure, and can be raised somewhat on a cylindrical perimeter stem wall to increase the storage capacity for a given dome radius. Domes are typically shot-creted to an external or internal airform. Allowance is made for multiple bulk materials by stacking the materials in separate regions under the dome, or by constructing multiple domes (one dome for each material). Reclaim from domes is accomplished in a variety of ways including: (a) a reclaim tunnel and draw points; (b) a loader (e.g., a front loader) and a truck; (c) a mechanical reclaimer, such as rakes and augers, which operates inside the dome to move the material to the center of the dome where the material is discharged down onto a conveyor belt in a tunnel; or (d) a combination of two or more of the above.

Storage barns are typically long and wide, A-frame, steel trussed buildings. They are very much like a dome in that the bulk material sits in a pile(s) under the barn, typically on a concrete pad, and typically the material does not touch the roof surface. Barns are different from domes in that they are longitudinally oriented rather than radially oriented. Multiple bulk solids are handled in barns by designating specific regions or lengths of the pile(s) to a particular material. Reclaim from barns is typically performed With mechanical reclaimers, the most prevalent being the bucket type scraper, or augers which traverse the sloping faces of the piles, drawing the material down to a discharge conveyor that resides in a trench along the side(s) of the pile. Another means of reclaim is tunnel reclaim under the pile with a rotary plow which traverses the length of the pile, essentially digging the material from the bottom of the pile and depositing it on a discharge conveyor.

Highwalls are a truncated version of open stockpiles in that the percentage of live reclaim is increased by truncating, on one or more sides, the toe of a conical or long pile. Multiple bulk materials are accommodated by providing multiple highwall piles (one pile for each material). Reclaim is accomplished with loader and truck, or with reclaim tunnels with discrete draw points which are typically near the highwall to optimize the live reclaim potential.

Open stockpiles are formed with fixed or mobile cantilevered stackers or, in the case of coal and coke, with stacking tubes. Multiple bulk materials are accommodated with multiple open stockpiles. Reclaim is typically accomplished via reclaim tunnels with discrete, fixed draw points, but mechanical reclaimers such as rakes and bucket wheels are still prevalent.

While these prior art storage and reclaiming means are generally effective for the storing and reclaiming of bulk solids, they do have some drawbacks. In the first instance, the height of storage structures, such as bins as silos, is generally limited by the cost of construction. As a general rule-of-thumb, the taller the structure, the thicker the walls of the structure will need to be (in order to resist earthquake loads as well as to contain the static loads imposed by the weight of the material stored within the structure). Any storage structure of significant height (for example, 15 meters or more) will be constructed from concrete. While very tall concrete structures can be formed, the cost of forming such tall structures typically outweighs the financial benefit of providing the tall structure, such that it is not economical to build such structures.

Secondly, each of the prior art bulk storage means described above allows, in one way or another, for multiple bulk materials to be stored. However, in most instances (with the exception of open stockpiles, for example) each of the prior art storage means do not provide flexibility with respect to accommodating the storage of multiple bulk materials. For example, a gang of eight discrete silos can store up to eight different bulk materials. However, if only two different bulk materials are to be stored in an 8-silo structure (in equal portions), then four silos must be dedicated to each material. In this instance, reclaiming one of the bulk materials requires unloading four separate silos. Generally, it takes longer to unload four silos of a first size than to unload a single silo that is four times as large as the first size.

As indicated above, it is desirable to provide a bulk storage bin or silo with the capacity for "live" reclaiming. That is, "live" reclaiming allows essentially all of the bulk material stored in the bin or silo to be unloaded, such that there is no material left in a "dead" zone within the bin or silo. For very large storage bins live reclaiming is achieved by providing a number of metered gates along the bottom of the bin, as also described above. When the bottom of a storage bin is an extended "V" shaped bottom, then live reclaiming generally requires that the bulk material be unloaded at every point along the V-shaped bottom. This requires a significant number of metered gates to accomplish, thus increasing the cost of the reclaiming system. As an alternative, the bottom of the bin can be formed as several in-line conical bottoms, such that a metered gate is only required for each conical bottom. However, this latter arrangement reduces the storage volume of the bin over a continuous V-shaped bottom configuration.

What is needed then is methods and apparatus for storing bulk materials, and methods and apparatus for reclaiming bulk materials from a bulk material storage means, which achieve the benefits accorded by such prior art methods and apparatus, but which avoid the detriments variously associated therewith.

SUMMARY

One embodiment of the present invention provides for a material reclaiming apparatus for use with a bulk storage bin (or other bulk storage means) defining a storage volume. The bulk storage bin includes a bottom which further defines the storage volume. The bottom of the storage bin defines an elongated plurality of outlet openings from the storage volume. The material reclaiming apparatus includes a plurality of gates. Each gate is configured to be associated with a respective outlet opening, and each gate is moveable from a first (or "closed") position wherein the gate blocks the associated outlet opening, to a second (or "open") position wherein the gate does not block the associated opening. The reclaiming apparatus further includes a traveling reclaimer configured to be located beneath the bottom of the storage bin, and which is configured to travel along the bottom of the storage bin beneath the plurality of gates. The traveling reclaimer includes a gate actuator. As a result of positioning the traveling reclaimer under any given gate, the gate actuator automatically engages the given gate to allow the gate actuator to move the given gate from the first position to the second position.

Another embodiment of the present invention provides for a bulk storage bin which includes a foundation, and a continuous perimeter wall supported on the foundation and defining a storage volume. In plan view, the perimeter wall is defined by corrugated sections.

Yet another embodiment of the present invention provides for a bulk storage bin which includes a foundation and a continuous perimeter wall supported on the foundation. The continuous perimeter wall is defined by an upper edge distal from the foundation. The perimeter wall defines (at least in-part) a storage volume, the storage volume being further defined by an upper opening at the upper edge of the perimeter wall. The continuous perimeter wall includes generally parallel, elongated side portions. The storage bin further includes a dividing wall placed between the side portions of the perimeter wall to thereby divide the storage volume into first and second storage compartments. Further, the dividing wall includes a plurality of removable wall segments configured to be lowered into the storage volume through the upper opening.

These and other aspects and embodiments of the present invention will now be described in detail with reference to the accompanying drawings, wherein:

DETAILED DESCRIPTION

Figure 1A:
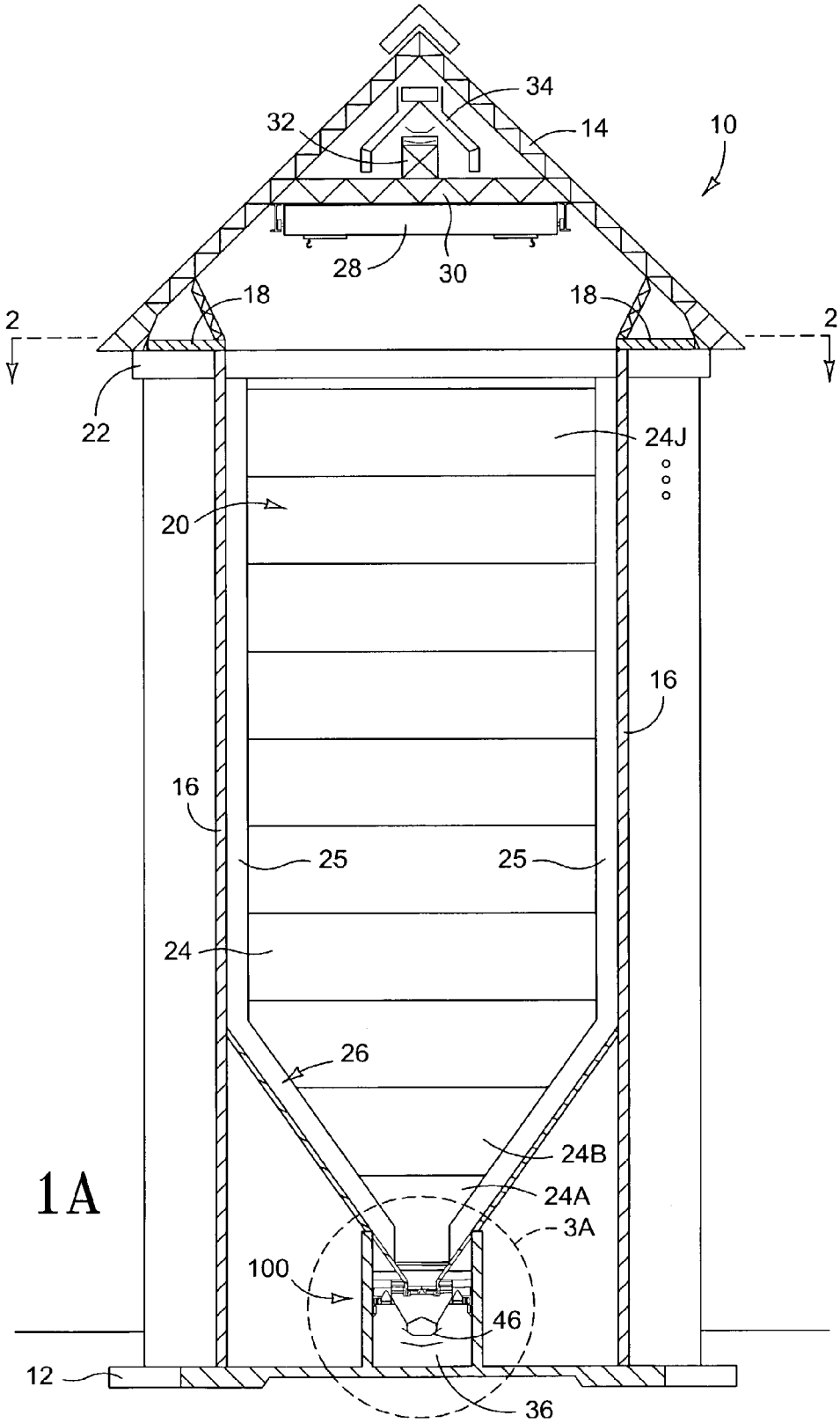
FIG. 1A is a first front elevation, sectional view of a bulk storage bin in accordance with one embodiment of the present invention, which is depicted in plan view in FIG. 2.

As will be described more particularly below, embodiments of the present invention provide for a material reclaiming apparatus which is particularly useful for reclaiming (i.e., removing) materials such as (by way of example only) raw sulfur, raw coal (versus "clean coal"), and mine ores (e.g., iron ore, copper ore, etc.), as well as other materials, from a bulk storage means, such as a bulk storage bin. Further embodiments of the present invention provide for a bulk storage bin that is useful for storing and reclaiming such aforementioned materials, as well as for methods of efficiently and economically reclaiming materials from a bulk storage means.

In one embodiment wherein a bulk storage means includes a plurality of gates disposed within an outlet from the bulk storage means, a traveling reclaimer is provided which is configured to move along beneath the gates and to selectively open or close the gate which the traveling claimer is currently positioned beneath. In this way, a single traveling reclaimer can be used to service (i.e., open and close, and facilitate extraction of material from) a plurality or gates in a bulk storage bin. That is, rather than providing a reclaiming apparatus for each gate, a single "traveling" reclaimer can service multiple gates. This results in an obvious cost savings in the construction of a bulk storage bin having multiple unloading gates. (As used herein, "reclaimer" means an apparatus for facilitating the removal of material from a bulk storage bin or other bulk storage means.) Further, the traveling reclaimer, which is the subject of one embodiment of the present invention, can be provided with a material metering device to generally control the rate of flow of material from the bulk storage bin to a material receiver. (A "material receiver", as used herein, means an apparatus or thing which is intended to receive material reclaimed directly from the bulk storage bin. In one example a material receiver comprises a conveyor disposed along the row of gates in the storage bin. In another example a material receiver comprises one or more railcars or trucks.) In another arrangement in accordance with the present invention a bulk storage bin having a plurality of outlet gates can be provided with two (or more) traveling reclaimers. If the bulk storage bin is segmented into multiple storage compartments, then a traveling reclaimer can be provided for each storage compartment. Further, if each traveling reclaimer associated with each storage compartment is provided with a material metering device, and the material receiver is a continuous conveyor, then the traveling reclaimers can be used to selectively extract material from each storage compartment. If a different material is stored in each storage compartment, then the traveling reclaimers can be used to "blend" the different materials from the different storage compartments onto the conveyor by the selective extraction of the materials from the storage compartments.

Although the traveling reclaimer of the present invention will be described below with respect to being used in a bulk storage bin, it will be appreciated that the traveling reclaimer can be used with any of the bulk storage means described above in the section entitled, "Background". More particularly, the traveling reclaimer can be used with any bulk storage means which provides multiple reclaiming points (openings) where a gate can be provided, such that a plurality of gates are provided which can be accessed by the traveling reclaimer. While embodiments described below depict the plurality of gates as being in alignment (i.e., in a straight row), this is not a requirement, and the gates can be arranged in any pattern (e.g., along a curvilinear path) which can be accessed by the traveling reclaimer.

A further embodiment of the present invention provides for a bulk storage bin that has a "corrugated" (i.e., undulated, or having a sinusoidal-type shape) wall when viewed in plan view. Preferably the wall is fabricated as a "honeycomb"-type concrete structure. This design provides for a bulk storage bin wall having enhanced rigidity, which in turn allows the walls to be much taller for a given thickness than conventional concrete retaining type walls used for bulk storage. In a further embodiment of the present invention, a bulk storage bin has removable bulkheads allowing the gross storage volume of the bin to be segmented into multiple storage compartments so that different materials can be stored in the bin, yet isolated from one another. That is, the removable bulkhead allows for a reconfigurable bulk material storage bin.

Figure 2:
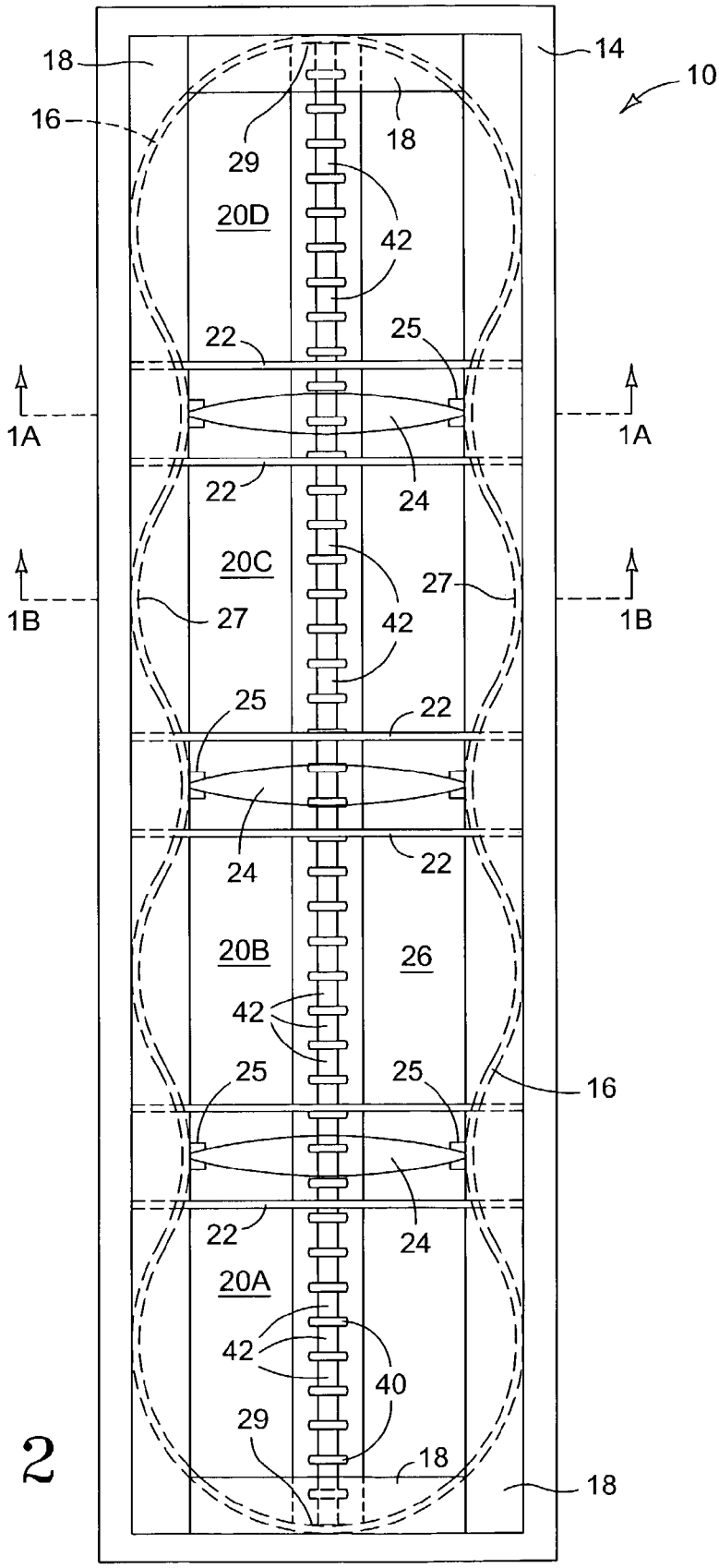
FIG. 2 is a plan sectional view of the bulk storage bin depicted in FIGS. 1A and 1B.

Turning now to FIG. 1A, a bulk storage bin 10, in accordance with an embodiment of the present invention, is depicted in a front elevation sectional view. The bulk storage bin 10 includes a foundation 12, a continuous perimeter wall 16 which is supported on the foundation, and a roof 14 which is supported on the perimeter wall. Turning briefly to FIG. 2, a cross sectional plan view of the bulk storage bin 10 of FIG. 1A is depicted. As can be seen in FIG. 2, in plan view the wall 16 includes opposing end portions 29 and generally parallel, elongated side portions 27 which are connected to the end portions. Spreader beams 22 can be provided to help maintain the upper ends of the side portions 27 in relatively fixed, spaced apart relationship to one another. The side portions 27 of the wall 16 can be described as "corrugated sections" of the wall, due to the sinusoidal-type (or undulated) shape of the side portions 27. The continuous perimeter wall 16 can be fabricated, for example, using methods and apparatus described in my U.S. patent application Ser. No. 10/131,838, filed Apr. 25, 2002, and entitled "Methods and Apparatus for Forming Concrete Structures", which is hereby incorporated by reference herein in its entirety. The perimeter wall 16 is described as being "continuous" by virtue of the fact that there are no gaps in the wall as the wall is traced around its perimeter in plan view (FIG. 2). The perimeter side wall 16 thus defines a storage volume 20, and the corrugated side portions 27 of the wall 16 thus define narrow sections where the side portions 27 are nearest to one another, and wide sections where the side portions 27 are farthest from one another. As depicted in FIG. 2, located at the narrow sections are bin dividers 24, which, as shown, segment the storage volume 20 into storage compartments 20A, 20B, 20C and 20D. However, the bin dividers 24 are not required, and one or more (or all) of them can be removed. As will be described more fully below, preferably the bin dividers 24 are removable so that the storage volume 20 can be selectively configured for various storage schemes. Angle brackets 25 (depicted only between compartments 20A and 20B) can be used to hold the bin dividers 24 in place when the bind dividers are removable. Alternately, slots (not shown) can be provided in the perimeter wall 16 to receive the removable bin dividers 24.

Figure 1B:
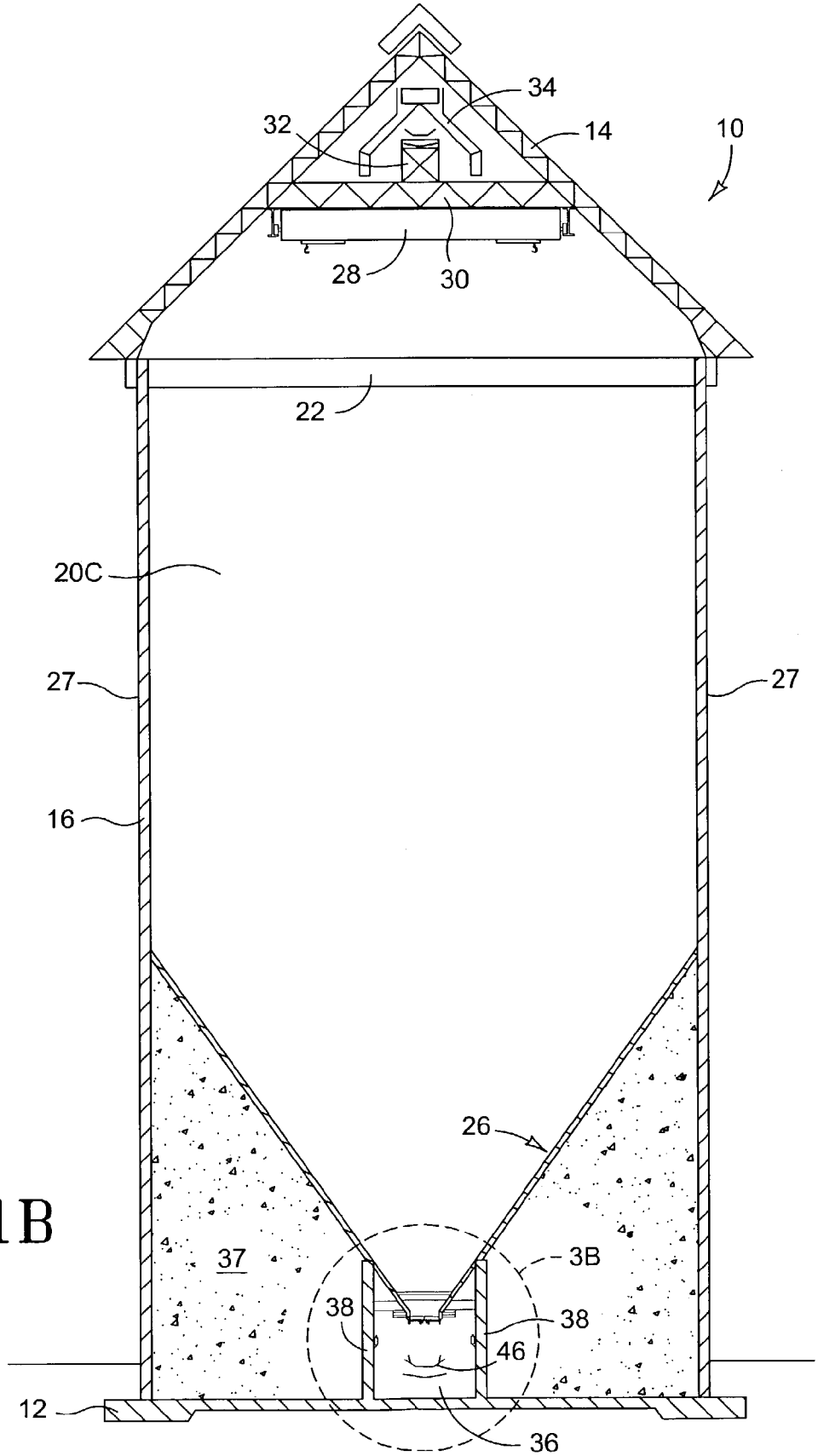
FIG. 1B is a second front elevation, sectional view of the bulk storage bin of FIG. 2.

Returning briefly to FIG. 1A, as can be seen, the section line for FIG. 2 is taken towards the bottom of the roof 14, but immediately above diaphragm panels 18. Returning to FIG. 2, it can be seen that diaphragm panels 18 form an essentially open, rectangular perimeter ring which covers the upper edge of the perimeter wall 16. The diaphragm panels 18 can facilitate stiffening of the overall structure of the bulk storage bin 10. As also indicated in FIG. 2, it can be seen that the sectional view of the storage bin 10 depicted in FIG. 1A is taken as a section at a narrow point between the side portions 27, and specifically at bin divider 24 which separates storage compartment 20C from compartment 20D. As also indicated in FIG. 2, FIG. 1B (described below) is a sectional view of the storage bin 10 taken as a section at a wide point between the side portions 27, in the center of storage compartment 20C. The bulk storage bin 10 further includes a bottom 26. A plurality of gates 42, separated by beam liners 40 (described more fully below), are disposed in an elongated in-line orientation in openings (not specifically shown) in the bottom 26 (as will be described more fully below).

As just described, FIG. 1B is a front sectional view of the bulk storage bin 10 depicted in FIGS. 1A and 2, but as viewed at a "wide section" between wall portions 27. Viewing FIGS. 1A and 1B together facilitates understanding of the "corrugated" nature of perimeter wall 16. As depicted in FIG. 1B, a reclaiming tunnel 36 can be defined by tunnel walls 38 under the bottom 26 of the storage bin 10. A fill material 37 can be placed on either side of the tunnel 36 between the foundation 12, the bottom 26 of the storage bin 10, and the tunnel wall 38, to facilitate supporting the bottom 26 against anticipated loads. The bottom 26 can be, for example, pre-cast concrete panels with a steel plate liner (not shown) placed over the concrete panels.

Turning back now to FIG. 1A, the bin divider 24 is depicted as being formed from a number of stacked bin divider segments 24A, 24B, etc. through 24J. This arrangement allows the bin divider 24 to be removable, as described above. A gantry crane 28, supported on rails by cross beams 30 (only one of which can be seen in FIG. 1A) can be used to put the bin divider segments 24A–24J in place, and to remove the bin divider segments as well. As described above, bin dividers 24 are not required, and, if provided, do not have to be removable.

Bulk material can be deposited in the storage volume 20 of the bulk storage bin 10 by a tripper conveyor 34 which is supported by a truss 32 under the roof 14 of the storage bin. Tripper conveyors are well understood in the materials handling arts, and need not be described further herein for an understanding of the embodiments of the present invention. In addition to a tripper conveyor, other means of conveying solids into a bulk storage bin can be used to place the bulk material into the storage volume 20. As depicted in FIG. 1A, bulk material can be removed (i.e., reclaimed) from the storage volume 20 by way of a traveling reclaimer 100, in accordance with another embodiment of the present invention. The traveling reclaimer 100 is located the reclaimer tunnel 36, which was described above with respect to FIG. 1B.

Figure 3A:
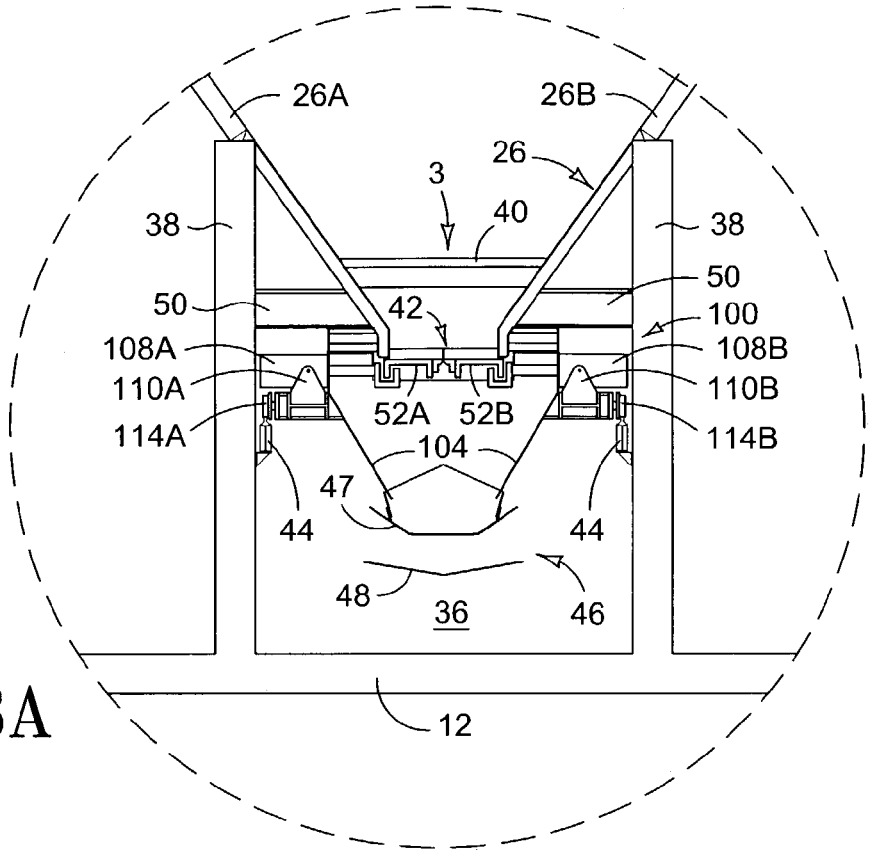
FIG. 3A is a detail of the bulk storage bin depicted in FIG. 1A, showing a traveling reclaimer (in accordance with another embodiment of the present invention) under a closed gate, and located in a tunnel beneath the storage volume.
Figure 3B:
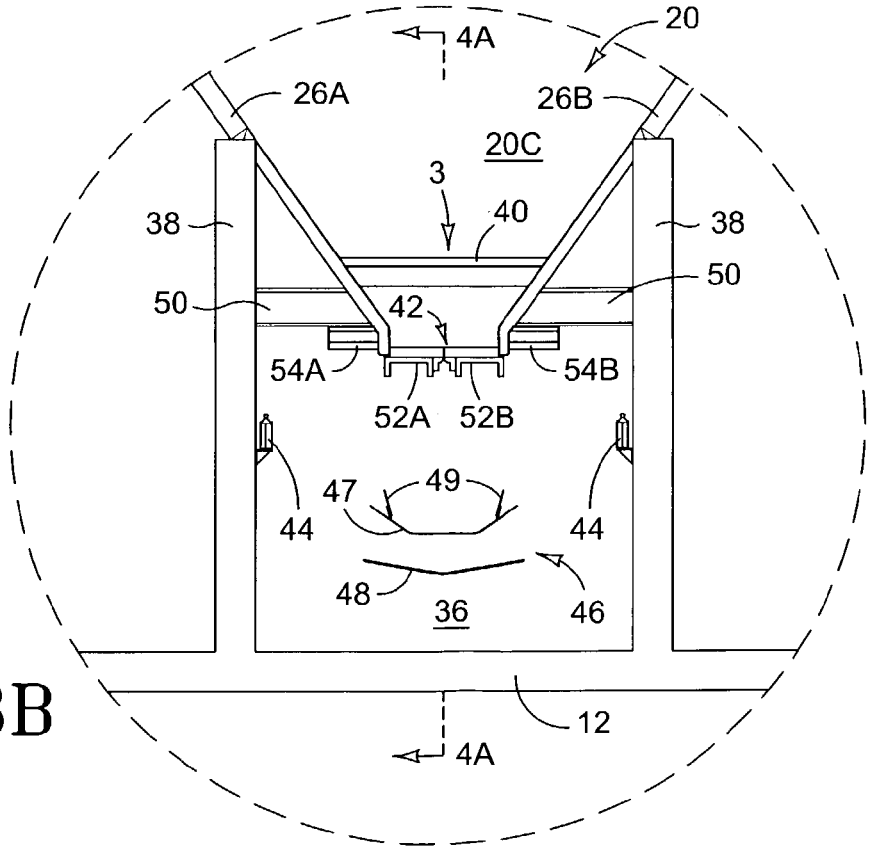
FIG. 3B is a detail of the bulk storage bin depicted in FIG. 1B, showing the tunnel beneath the storage volume when the traveling reclaimer of FIG. 3A is moved out from under a gate, and depicting the gate in the closed position.

Turning now to FIG. 3A, a detail diagram from FIG. 1A is shown. In FIG. 3A a front, sectional view of the reclaimer tunnel 36 is depicted. The bottom 26 of the storage bin 10 of FIG. 1A is a sloped bottom, formed from a first bottom wall 26A and a second bottom wall 26B, which are arranged in parallel, spaced-apart truncated "V" relationship to one another to thereby define a plurality of openings 3 (only one of which can be seen in FIG. 3A) from the storage volume (20, FIG. 2). The pair of parallel, spaced-apart tunnel walls 38 are located within the unloading (i.e., "reclaiming") tunnel 36 between the foundation 12 and the respective first and second bottom walls 26A, 26B. First and second rails 44 are each supported on a respective one of the pair of tunnel walls 38 in parallel, opposed arrangement, to thereby support the traveling reclaimer 100, which is configured to travel along the rails 44. A plurality of gates 42 (only one of which can be seen in FIG. 3A, but which can all be seen in FIG. 2) are provided, and a separate gate 42 is disposed in each outlet opening 3. Gate support beams 50 (two-for each gate, only one of which can be seen in FIG. 3A) support the gates 42 at the lower end of the bin bottom 26. The gate support beams 50 also act as tunnel spreader beams to maintain the tunnel walls 38 in spaced-apart relationship to one another. The upper edge of one of the-opening separation beam liners 40 (see also FIG. 2) can also be seen in FIG. 3A. As described above, beam liners 40 separate the openings 3 in which are disposed the gates 42. Turning briefly to FIG. 3B, the same view as is depicted in FIG. 3A is shown, except that in FIG. 3B the traveling reclaimer 100 of FIG. 3A has been moved out from under the gate 42, and is thus not visible in FIG. 3B. A comparison of FIGS. 3A and 3B facilitates understanding of those components which make up the traveling reclaimer 100. As can also be seen by viewing FIGS. 3A and 3B, a stationary conveyor 46 can be placed in the reclaimer tunnel 36. By "stationary conveyor" I mean that the conveyor 46 is fixed in place in the tunnel 36. Preferably, the conveyor 46 extends the length of the available gates 42 (e.g., in FIG. 2 the conveyor would extend from one end to the other of the storage volume 20). The conveyor 46 acts as a material receiver to receive bulk material from the storage volume 20 (FIG. 1A) of the storage bin 10 when a gate 42 is opened by the traveling reclaimer 100, as will be described more fully below.

The conveyor 46 can be a common material conveyor, which includes an endless belt. As depicted in FIG. 3B, the conveyor 46 (seen here in cross section) includes an upper portion 47 configured to receive material from the storage volume 20, a lower return portion 48, and guides 49 which facilitate in keeping material on the upper portion 47 of the conveyor 46. It will be appreciated that upper portion 47 and lower portion 48 of conveyor 46 are portions of the same, endless belt.

Figure 3C:
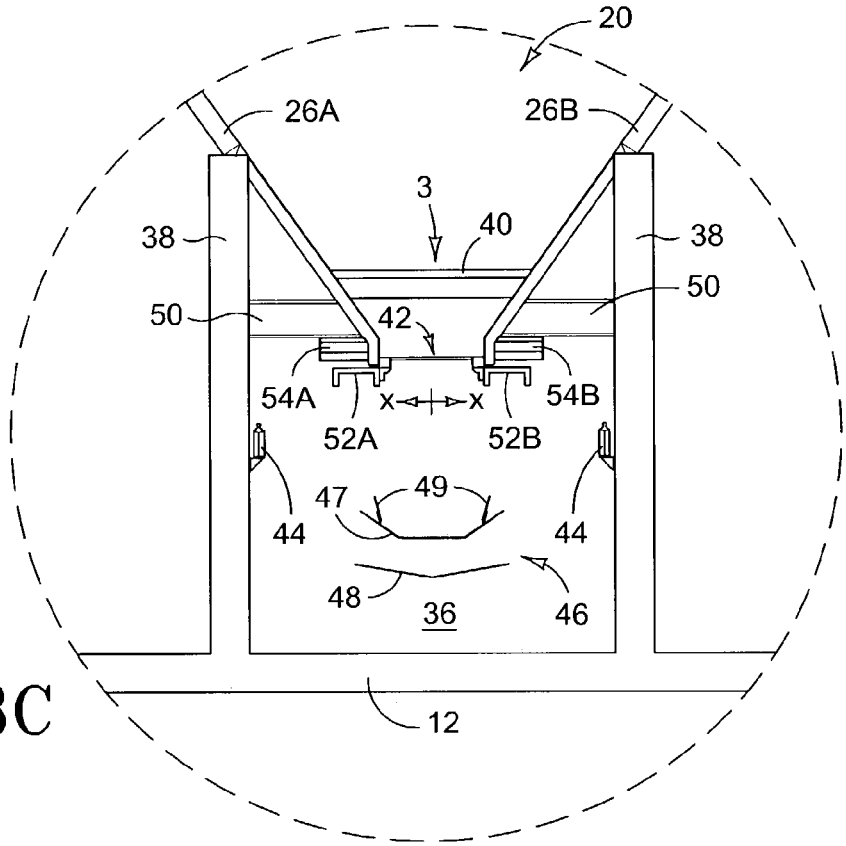
FIG. 3C is the same view as FIG. 3B, but showing the gate in an open position.

As depicted in FIG. 3B, each gate 42 comprises a first gate member 52A and a second gate member 52B, which are arranged in moveable opposed relationship to one another. However, a gate 42 can include only a single gate member. First gate member 52A is slidably mounted in a first gate guide 54A, and second gate member 52B is slidably mounted in a second gate guide 54B. Gate guides 54A and 54B are supported by the gate support beam 50. When the gate members 52A, 52B (and thus, the gate 42) are in a first (closed) position, as depicted in FIG. 3B, then the gate members 52A, 52B abut one another, as shown. However, to place the gate 42 in a second (open) position, the gate members 52A and 52B move away from one another. This is depicted in FIG. 3C, which is essentially the same view as depicted in FIG. 3B, except that in FIG. 3C the gates members 52A and 52B have been moved in directions "X" to place the gate 42 in the second or "open" position. As can be seen by comparing FIGS. 3B and 3C, the gates members 52A and 52B have translated in respective left and right "X" directions in respective gate guides 54A and 54B to move from the closed position of FIG. 3B to the open position of FIG. 3C. It will be appreciated that the gate 42 is configured to be opened by the traveling reclaimer 100 (FIG. 3A), and therefore the view depicted in FIG. 3C would not normally occur, and that FIG. 3C is thus provided primarily to facilitate understanding of the selectable positioning of the gate members 52A and 52B. It will also be appreciated that the gate members 52A and 52B can be positioned in any intermediate position between the fully open position of FIG. 3C and the fully closed position of FIG. 3B, to thereby facilitate metering of flow of bulk material through the opening 3. The gate members 52A and 52B can be provided in the form of a "knife gate" such that they abut one another along common edges when in the closed position (FIG. 3B). Such a "knife gate" arrangement allows the gate 42 to be closed even when the storage volume 20 has not been completely emptied and bulk material is still flowing through the gate 42, even as the gate is being closed. By providing sufficient force against the gate members 52A and 52B, and configuring the gate members to abut one another along common edges, any bulk material present between the gate members at the time they are closed will either be pushed aside or crushed, thus allowing the gate members 52A and 52B to meet in an abutting manner, thus closing the gate 42.

Figure 3D:
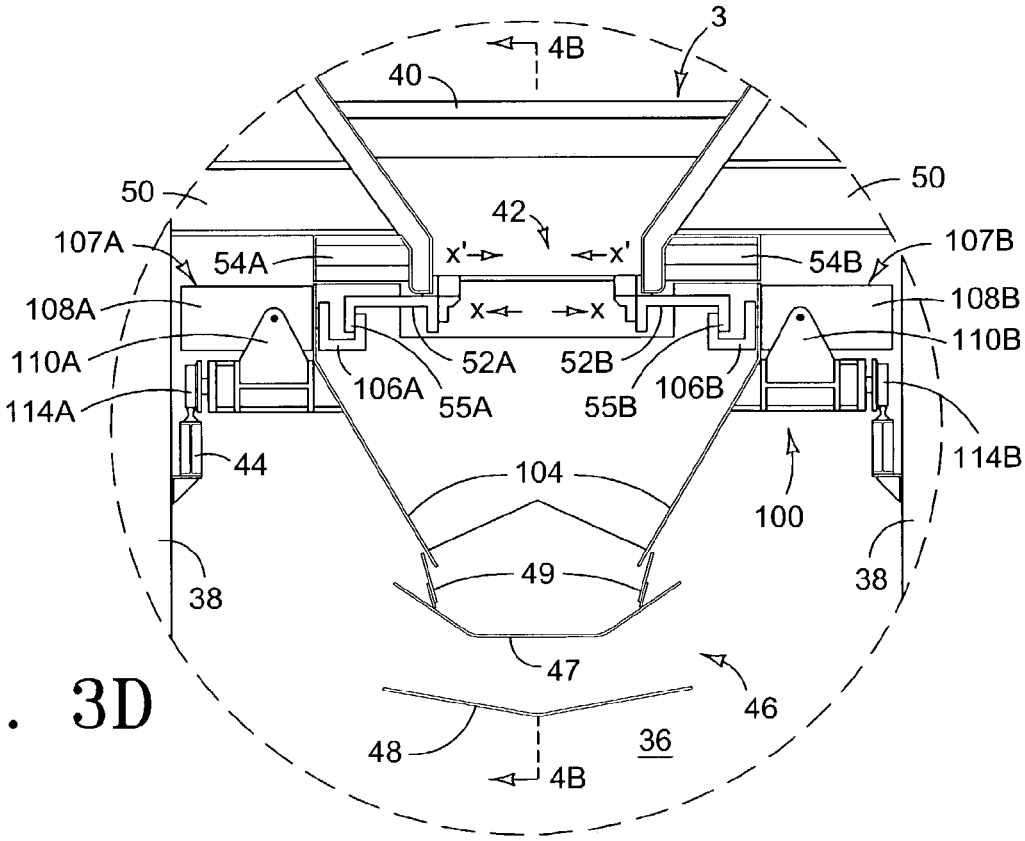
FIG. 3D is a detail diagram similar to FIG. 3A, but showing the traveling reclaimer as having opened the gate.

Turning now to FIG. 3D, a detail from FIG. 3A is shown. FIG. 3D depicts the traveling reclaimer 100 positioned beneath a gate 42, with the gate members 52A and 52B in the open position. FIG. 3D essentially corresponds to FIG. 3C, except that the traveling reclaimer 100 is shown in place in FIG. 3D, as it typically will be when the gate 42 is in the open position. The traveling reclaimer 100 will be described more fully below. As depicted in FIG. 3D, the direction of motion of the gate members 52A and 52B is generally perpendicular to the direction of travel of the traveling reclaimer 100. (The intended direction of travel of the reclaimer 100 is in directions into and out of the plane of the sheet on which FIG. 3D is drawn.)

As can be appreciated from the foregoing discussion, a material reclaiming apparatus in accordance with an embodiment of the present invention includes a plurality of gates 42 (FIG. 2). Each gate 42 is configured to be associated with a respective outlet opening (3, FIG. 3A) in the bottom (26) of a bulk storage bin or other bulk storage means. The gates 42 are each moveable from a first (closed) position wherein the gate blocks the associated outlet opening 3, to a second (open) position wherein the gate does not block the associated opening. Accordingly, in the second position bulk material can flow out of the opening 3. Generally, the traveling reclaimer 100, which is configured to be located beneath the bottom 26 of the bulk storage bin 10, is configured to travel along the bottom 26 beneath the plurality of gates 42. As will be described more fully below, the traveling reclaimer 100 includes a gate actuator (not numbered in FIG. 3A, but described below). As a result of positioning the traveling reclaimer 100 under any given gate 42, the gate actuator engages the given gate 42 to thereby allow the gate actuator to move the given gate from the first (closed) position to the second (open) position. That is, a given gate is "automatically" engaged by the gate actuator merely as a result of locating the traveling reclaimer 100 under the gate. No special actions are needed for the gate actuator to engage the gate 42 for actuation. This allows for simplification of design and operation of the gate-actuating capabilities of the traveling reclaimer 100. It will be appreciated that bulk material handling, particularly of bulk materials such as ores and raw sulfur, presents an extremely harsh environment, and mechanical equipment is subject to impact (and therefore damage) by the bulk materials, as well as fouling from dust and the like. Accordingly, reducing the number of operating components, and operator intervention, can contribute to improved reliability and safety of the material reclaiming apparatus.

Returning now to FIG. 3D, each gate member 52A, 52B includes a downward extending flange (respectively, flanges 55A and 55B), the function of which will be described shortly. The traveling reclaimer 100 is depicted as including first and second gate actuators 107A and 107B (to engage and actuate respective gate members 52A and 52B). The traveling reclaimer 100 further includes a carriage 102 (which rides on rails 44), and which supports the gate actuators 107A and 107B. Gate actuator 107A includes a channel section (or "gate engaging member") 106A which is configured to receive the downward extending flange 55A (of gate member 52A) when the traveling reclaimer 100 is positioned beneath a specific or given gate 42. Likewise, gate actuator 107B includes a channel section 106B which is configured to receive the downward extending flange 55B of gate member 52B. The channel sections 106A and 106B can be considered as respective first and second (gate) engaging members. The gate actuators 107A and 107B include respective hydraulic cylinders 108A and 108B which can be used to move the respective channel sections, 106A and 106B in directions X and X' to respectively open and close the gate 42. The channel sections 106A and 106B can then urge the flange portions (respectively, 55A and 55B) of the respective gate members (52A, 52B) in directions X and X', and thereby move the gate 42 from the first (closed) position (FIG. 3A) to the second (open) position (FIG. 3D). Gate actuators 107A and 107B can be supported on the carriage 102 by respective pivot mountings 110A and 110B, to thus allow slight rotational movement in clockwise and counterclockwise directions (as viewed in FIG. 3D) to facilitate the "automatic" engagement of the flange portions 55A, 55B by respective channel sections 106A, 106B. Further, the flanges 55A, 55B, when viewed in side view, can have rounded edges to facilitate engagement by the channel sections 106A, 106B when the traveling reclaimer 100 is moved into position under the gate 42.

As will be appreciated, the hydraulic cylinders 108A and 108B of the gate actuators 107A and 107B allow the actuators to be controllable to thereby selectively control the position of the gate 42 by controlling the positioning of the gate members 52A and 52B. That is, the gate members 52A, 52B (and hence gate 42) can be positioned by the hydraulic cylinders 108A, 108B to the first (closed) position (FIG. 3B), to the second (open) position (FIG. 3D), and to intermediate positions between the first position and the second position. In this way flow of bulk material through the opening 3 can be regulated by selectively positioning the gate members 52A, 52B using the hydraulic cylinders 108A, 108B.

Figure 4A:
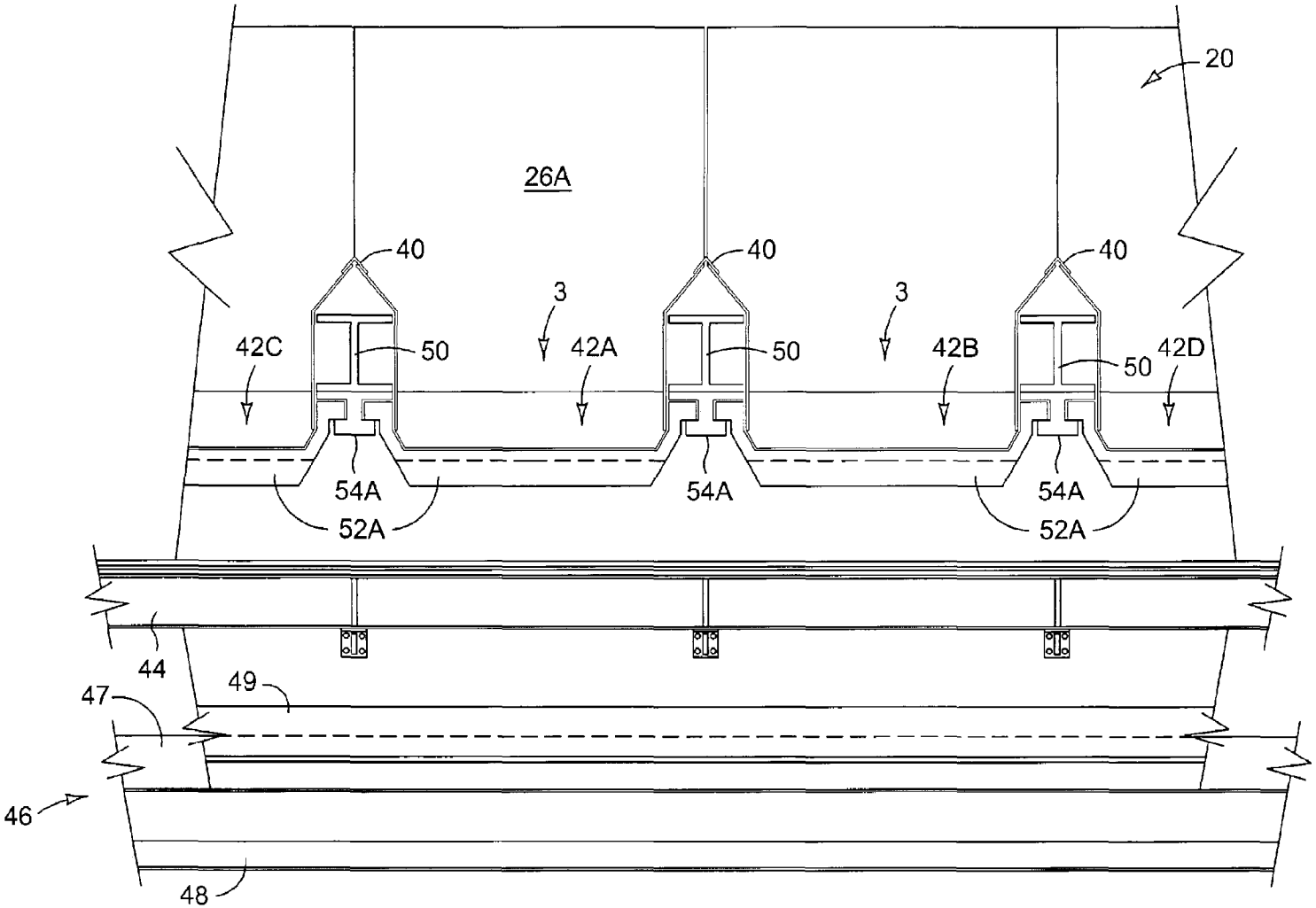
FIG. 4A is a side elevation sectional view of the gates and tunnel depicted in FIG. 3B, when the traveling reclaimer is not under one of the depicted gates.

Turning now to FIG. 4A, a side elevation sectional view taken from FIG. 3B is shown. FIG. 4A is a truncated view along the section, as it will be appreciated from FIG. 2 that a full sectional view would entail depicting an impractical number of gates 42. Accordingly, only two gates, 42A and 42B, are fully depicted in FIG. 4A, and gates 42C and 42D are partially depicted. In FIG. 4A the traveling reclaimer 100 of FIG. 3A is not seen. As will be appreciated from FIG. 3B, the section depicted in FIG. 4A depicts only the first bottom wall 26A, the first gate members 52A, and the first gate guides 54A. The gate support beams 50 are located between each gate 42 (42A–42D), and each gate support beam 50 is capped with a beam liner 40 which also functions as an opening-separation device. As seen in FIG. 3B, the gate support beams 50 penetrate the bottom walls 26A and 26B, and therefore, within the storage volume 20, the beams 50 are protected by beam liners 40. As seen in FIG. 4A, the beam liners 40 act to separate one outlet opening 3 from another, and thus produce the plurality of outlet openings in the bottom 26 of the storage bin 10 (FIG. 1A). Thus, as seen in FIG. 4A, each gate (gate member 52A) is positioned between two gate support beams 50, such that each opening 3 (and consequently, each gate 42) is separated by beam liners 40. One of the rails 44 on which the traveling reclaimer 100 (FIG. 3A) can travel is also visible in FIG. 4A, as well as a cross section of the conveyor 46, described above with respect to FIG. 3B.

Figure 4B:
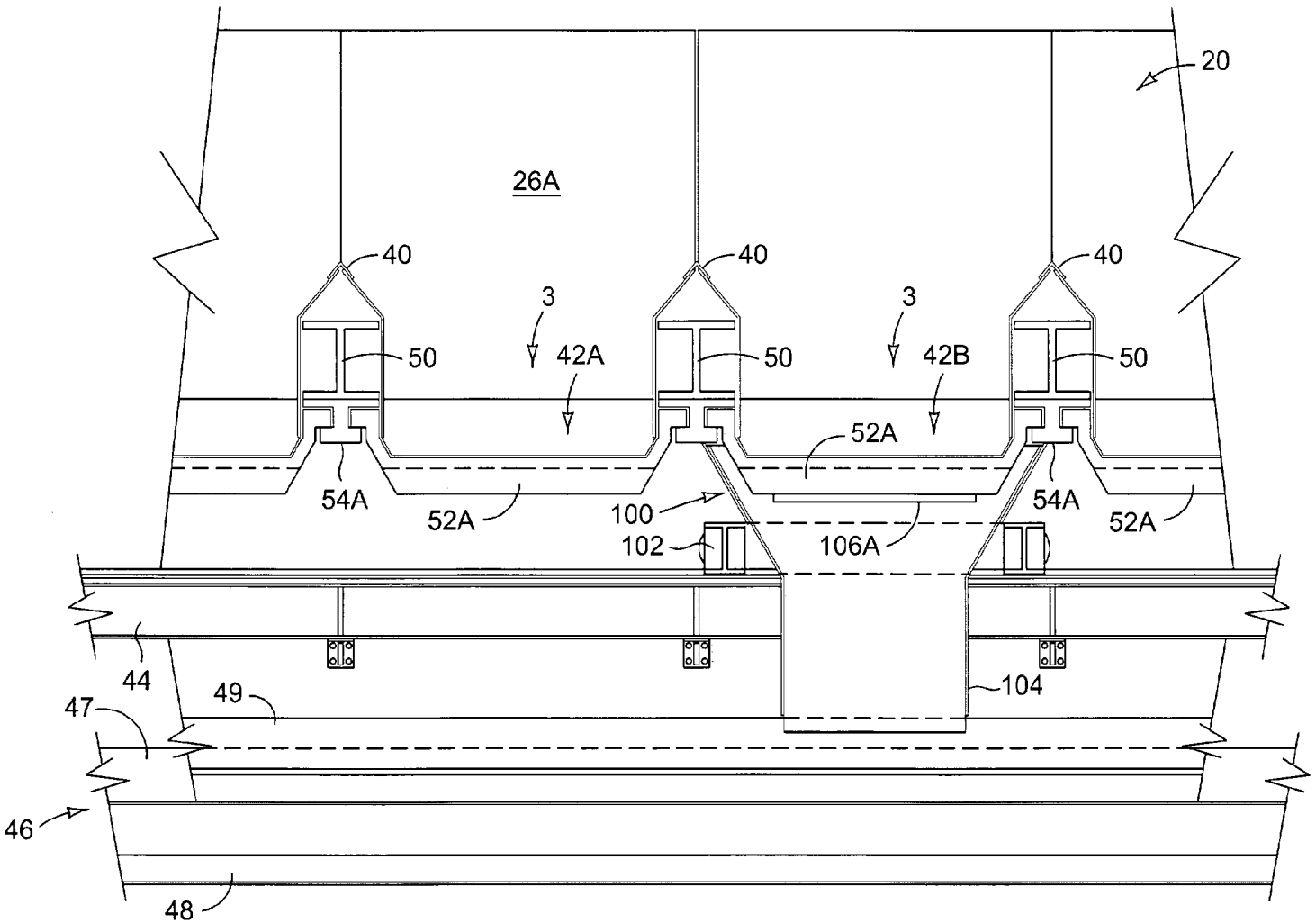
FIG. 4B is the same view as FIG. 4A, but with the traveling reclaimer of FIG. 3B under one of the gates.

Turning now to FIG. 4B, a side elevation sectional view similar to FIG. 4A is depicted. However, in FIG. 4B a traveling reclaimer 100 is depicted as being in place under gate 42B. FIG. 4B generally corresponds to a sectional view taken from FIG. 3D, except that the full traveling reclaimer 100 is shown in FIG. 4B to facilitate understanding of the invention. As depicted in FIG. 4B, the lower edge of channel section 106A can be seen, which engages the flange portion 55A (FIG. 3D) of the first gate member 52A. In FIG. 4B the traveling reclaimer 100 is depicted as including a hopper 104 which is supported by the reclaimer carriage 102. The hopper 104 is configured to be aligned under the gate 42B when the traveling reclaimer 100 is positioned under the gate. The hopper 104 facilitates in guiding bulk material from the storage volume 20, through the opening 3 associated with gate 42B, and onto the upper portion 47 of conveyor 46. In other configurations wherein the conveyor 46 is not used, the hopper 104 can be used to guide material into any type of material receptacle, such as railcars and the like.

Figure 5:
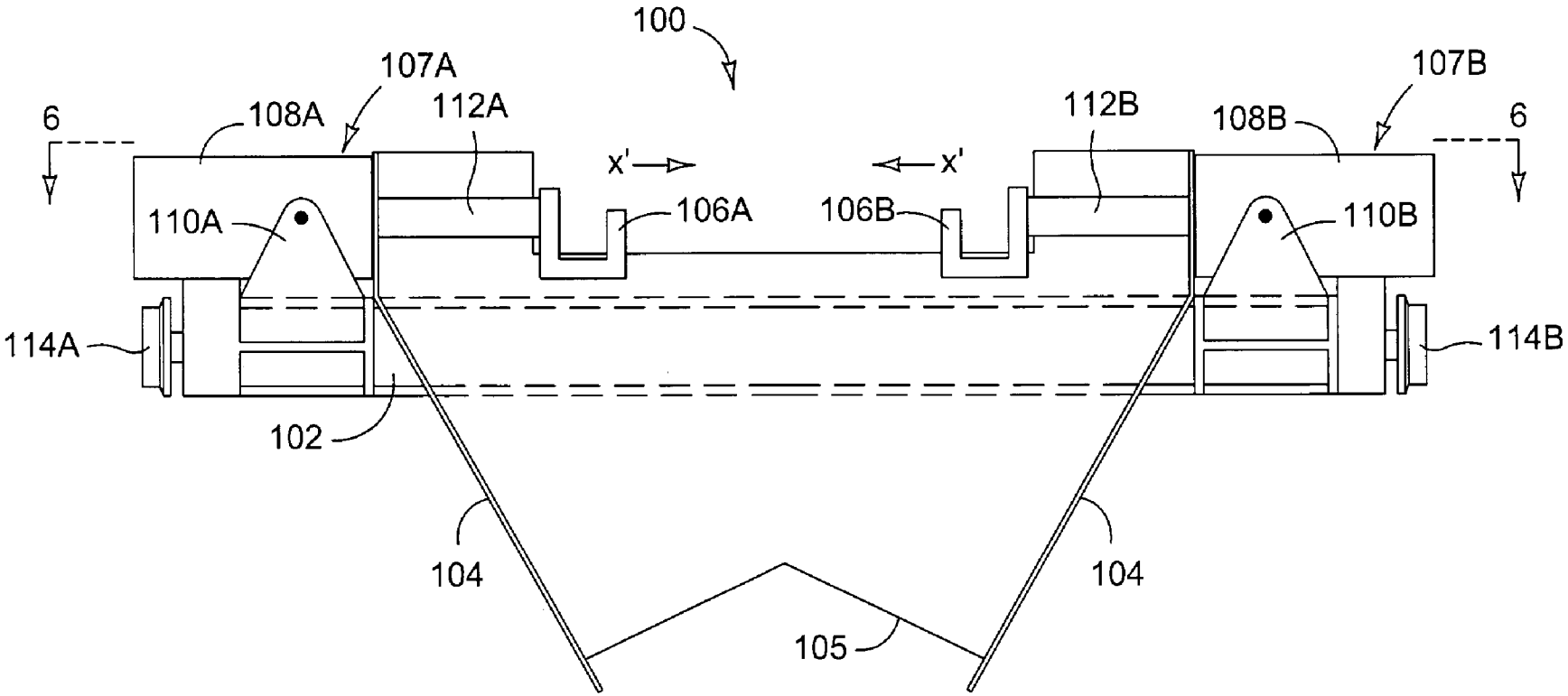
FIG. 5 is a front view of the traveling reclaimer depicted in FIG. 3A.

Turning now to FIG. 5, a front elevation view of the traveling reclaimer 100 is shown. Most of the components of the traveling reclaimer 100 of FIG. 5 were described earlier with respect to FIG. 3D, including the carriage 102 which supports the first and second gate actuators 107A and 107B via pivot mountings 110A and 110B. The gate actuators 107A and 107B are depicted in FIG. 5 as being in a position which would result in a gate being closed, such that pistons 112A and 112B are extended from respective hydraulic cylinders 108A and 108B, thus placing the gate engaging members (channel sections) 106A and 106B in positions X'. As can be seen in FIG. 5, the hopper 104 can include an inverted "V" shaped cutout to allow material deposited on the conveyor upper portion 47 (FIG. 4B) to more easily be moved along the conveyor (46, FIG. 4B), yet allow the left and right sides of the hopper (104, FIG. 5) to interact with the conveyor guides 49 (FIG. 3D) to assist in keeping material on the conveyor 46. Wheels 114A and 114B (FIG. 5) are supported by the carriage 102 to allow the traveling reclaimer 100 to move along the rails 44 (FIG. 3D).

Figure 6:
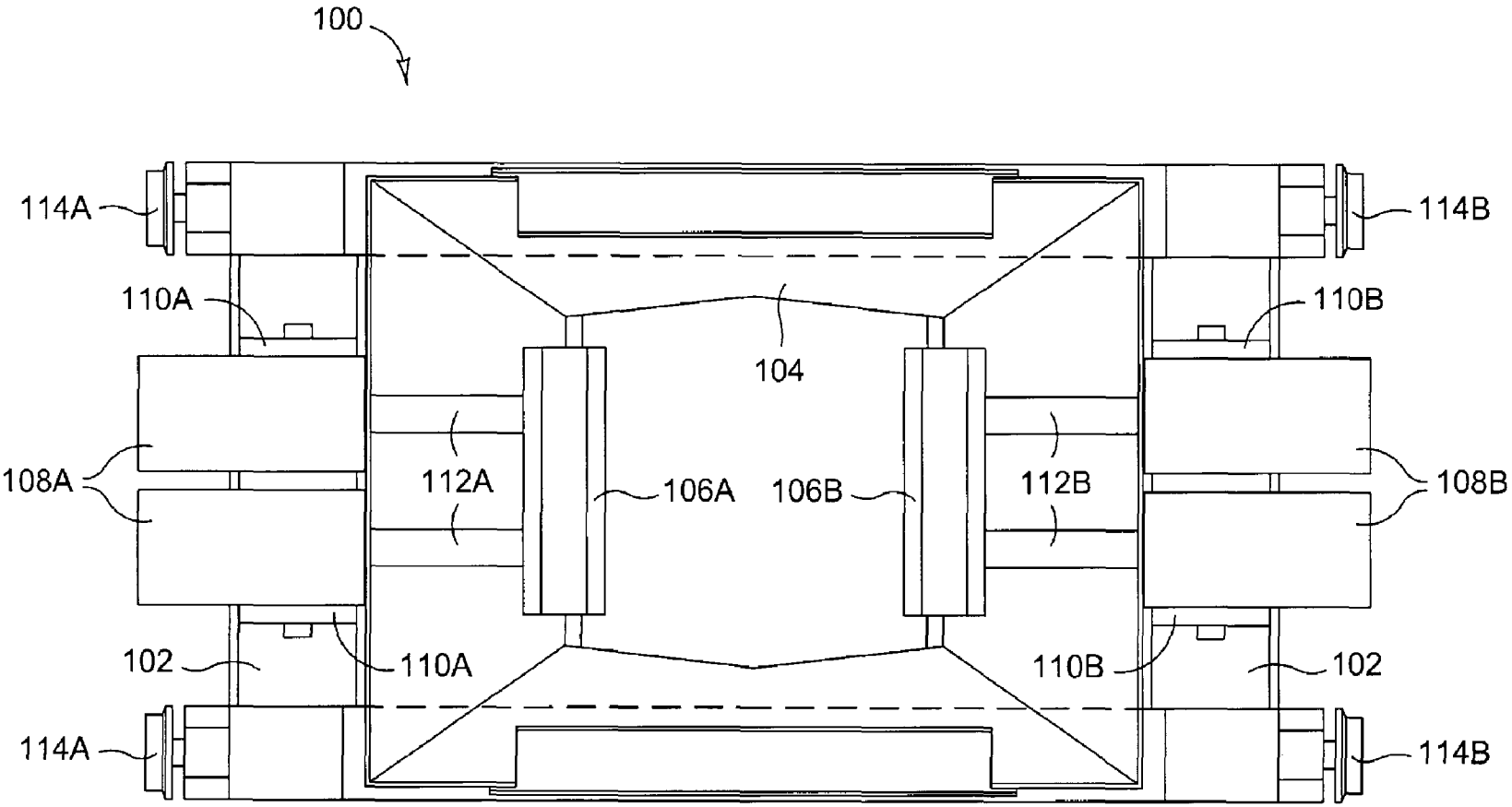
FIG. 6 is a plan view of the traveling reclaimer depicted in FIG. 5.

FIG. 6 is a plan view of the traveling reclaimer 100 depicted in FIG. 5. As can be seen in FIG. 6, two hydraulic cylinders 108A (and associated pistons 110A) can be provided for gate engaging member 106A, and two hydraulic cylinders 108B (and associated pistons 10B) can be provided for gate engaging member 106B. The use of two hydraulic cylinders (108A, 108B) for each gate engaging member (106A, 106B) can facilitate closing the gate members (52A, 52B, FIG. 3D) against the flow of bulk material past the gate members. As can also be seen in FIG. 6, four wheels 114A and 114B are supported by the carriage 102 at the four corners of the carriage. The wheels 114A, 114B allow the traveling reclaimer 100 to be supported by rails 44 (FIG. 3D). The use of four support wheels 114A, 114B (FIG. 6) for the traveling reclaimer 100 facilitates in stabilizing the reclaimer on the rails 44 (FIG. 3D).

Figure 7:
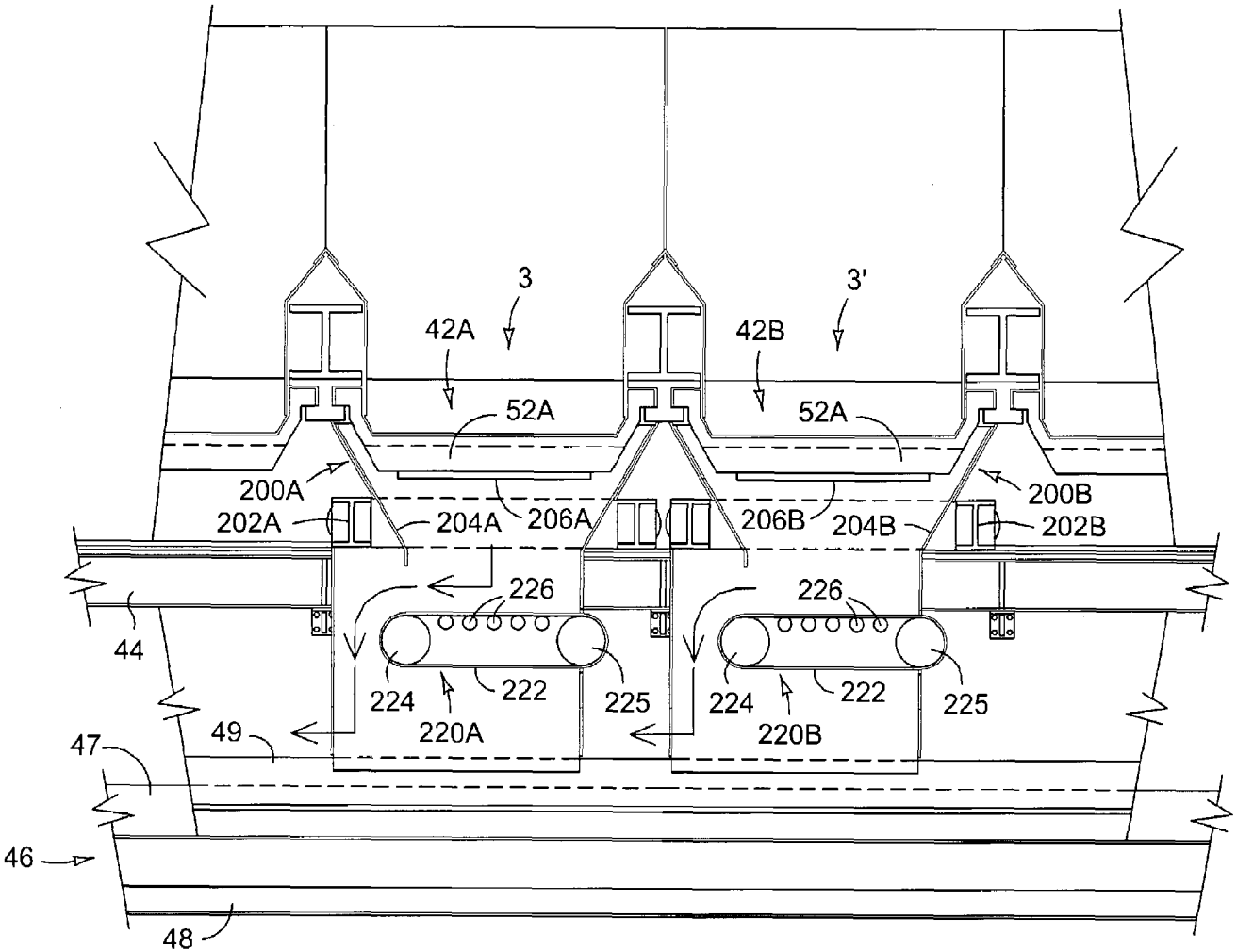
FIG. 7 is a side elevation sectional view similar to FIG. 4B, but depicting two traveling declaimers in the tunnel under the gates, and wherein the traveling reclaimers include metering conveyors.

As indicated above, rather than providing the bulk storage bin 10 (FIG. 1A) with only a single traveling reclaimer 100, two or more traveling reclaimers can be used. As also indicated above, a traveling reclaimer can be provided with a material metering device to regulate flow of bulk material from the storage volume 20 onto the conveyor 46 (FIG. 3A) or onto or into any other type of material receiving device. One example wherein two traveling reclaimers are used, each having a material metering device, is depicted in side elevation sectional view in FIG. 7. It will be appreciated that FIG. 7 is similar to FIG. 4B, which is a side elevation sectional view showing a single traveling reclaimer 100. In FIG. 7 a first traveling reclaimer 200A, and a second traveling reclaimer 200B, are located in the unloading tunnel 36. First and second traveling reclaimers 200A, 200B are configured to move along rails 44, and open gates (42A, 42B), all in a manner similar to that described above with respect to traveling reclaimer 100 (FIGS. 1A, 3A, 3D and 4B). First traveling reclaimer 200A is depicted as being located under gate 42A to receive material through opening 3, and second traveling reclaimer 200B is depicted as being located under gate 42B to receive material through opening 3'. First traveling reclaimer 200A includes a first reclaimer gate actuator (similar to gate actuator 107A of FIG. 3D), of which only the lower edge of channel section 206A is visible in FIG. 7. Second traveling reclaimer 200B includes a second reclaimer gate actuator (also similar to gate actuator 107A of FIG. 3D), of which only the lower edge of channel section 206B is visible in FIG. 7. The first and second reclaimer gate actuators for reclaimers 200A and 200B can operate similarly to gate actuators 107A and 107B, described above with respect to FIG. 3D, to open and close respective gates 42A and 42B (FIG. 7).

Each traveling reclaimer 200A, 200B of FIG. 7 includes a respective carriage 202A and 202B, which in turn supports a respective hopper 204A, 204B. Hoppers 204A and 204B are configured to guide material from the bulk storage bin volume 20 to a material receiving receptacle (here, upper portion 47 of conveyor 46) when respective gates 42A and 42B are in the open position. Further, as depicted in FIG. 7, each traveling reclaimer 200A, 200B is provided with a material metering device (respectively, 220A, 220B). The material metering devices 220A, 220B are configured to be positioned under the respective gates 42A, 42B when the reclaimers 200A, 200B are in the indicated positions. The metering devices 220A, 220B facilitate in metering the flow of bulk material from the bulk storage bin volume 20 to the conveyor 46 when the gate (42A or 42B, respectively) is in the open position. As depicted, metering devices 220A and 220B are metering conveyors, and are constructed similar to one another. Metering device 220A includes a conveyor belt 222 which is driven by one or both of drive wheels 224 and 225. Drive wheels 224 and 225 can be driven by an electric or hydraulic motor (not shown) and a gear box (also not shown). Preferably, the motor(s) used to drive the drive wheels 224 and/or 225 includes a speed controller, such that the rate of movement of the conveyor belt 222 can be controlled, thus allowing the metering device 220A to control the rate at which the conveyor belt 222 moves material out of the storage volume 20 and onto the upper portion 47 of primary conveyor 46. Idler rollers 226 can be provided to support the bulk material on the upper surface of belt 222. Metering device 220B can be constructed similarly to metering device 220A. Directional arrows are provided in FIG. 7 to show the flow of bulk material through the gates 42A, 42B, and eventually onto the conveyor 46, under the control of the metering devices 220A and 220B, respectively.

When gate 42A is separated from gate 42B by a bin divider (e.g., bin divider 24 of FIG. 2), and when different materials are provided in each storage compartment defined by the bin divider, then bulk material from the respective storage compartments can be individually metered onto the conveyor 46 by the metering devices 200A and 200B (FIG. 7). In this way a selected blending of bulk materials can be achieved by operating each of the metering devices 220A, 220B at selected rates (either at the same rate, or at different rates) to achieve a selected blending rate of different materials stored in each of the storage compartments. While traveling reclaimers 220A and 220B are depicted in FIG. 7 as being located adjacent to one another at respective gates 42A and 42B, it will be appreciated that the reclaimers 200A and 200B can each be located at other gates that are distal from one another, and separated by intermediate gates.

Figure 8:
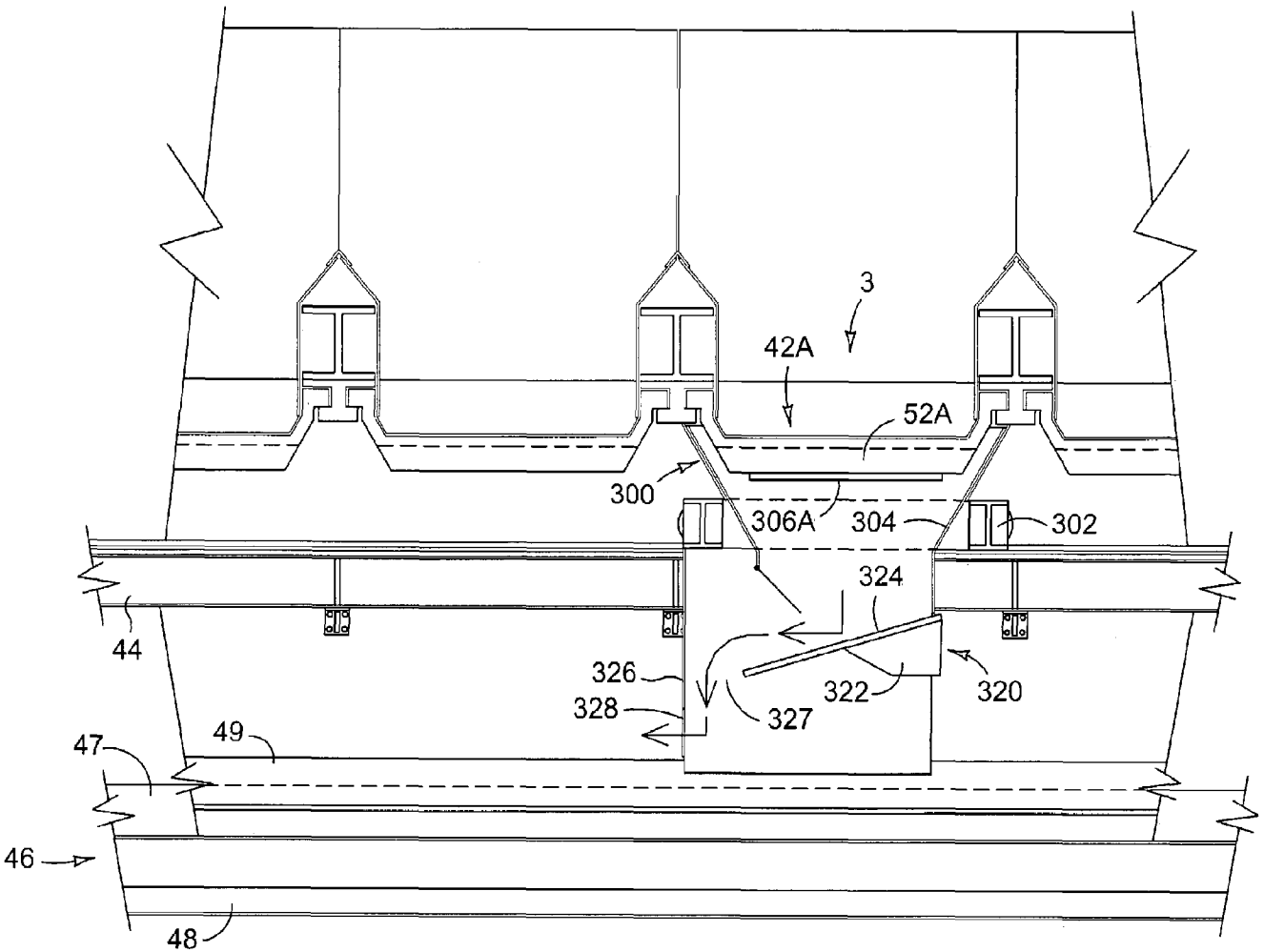
FIG. 8 is a side elevation sectional view similar to FIG. 7, but depicting a single traveling reclaimer as including a vibratory pan feeder instead of a metering conveyor.

Turning now to FIG. 8, a side elevation sectional view similar to that shown in FIG. 4B is provided. The view shown in FIG. 8 depicts a single traveling reclaimer 300 located at gate 42A. Reclaimer 300 includes carriage 302 which is configured to ride on rails 44. A gate engaging member (here, depicted by lower edge of channel section 306A, similar to channel section 106A of FIG. 4B) is configured to engage gate member 52A, thus allowing the traveling reclaimer 300 to selectively open and close gate 42A in the manner described above with respect to FIG. 3B for reclaimer 100. The traveling reclaimer 300 (FIG. 8) includes a hopper 304 (similar to hopper 104 of FIG. 3D), except that hopper 304 includes a lower extension 326. Located within the lower extension 326 of hopper 304 is a material metering device, which here is depicted as being a vibratory pan feeder 320. Vibratory pan feeders are well known in the material handling arts, and need not be described in detail for comprehension of the embodiment depicted in FIG. 8. The vibratory pan feeder 320 includes a pan 324 which is configured to receive bulk material from opening 3 via (open) gate 42A. A motive source 322 (such as an eccentrically driven weight) can cause the pan 324 to vibrate. Thus, bulk material deposited on the pan 324 from the opening 3 will progress in a leftward and downward direction on the pan 324 (as viewed in FIG. 8, and in the direction indicated by the arrows in FIG. 8), and the material will then drop through gap 327 and onto the upper portion 47 of the conveyor 46 from opening 328 in the extension 326 of hopper 304.

Figure 9:
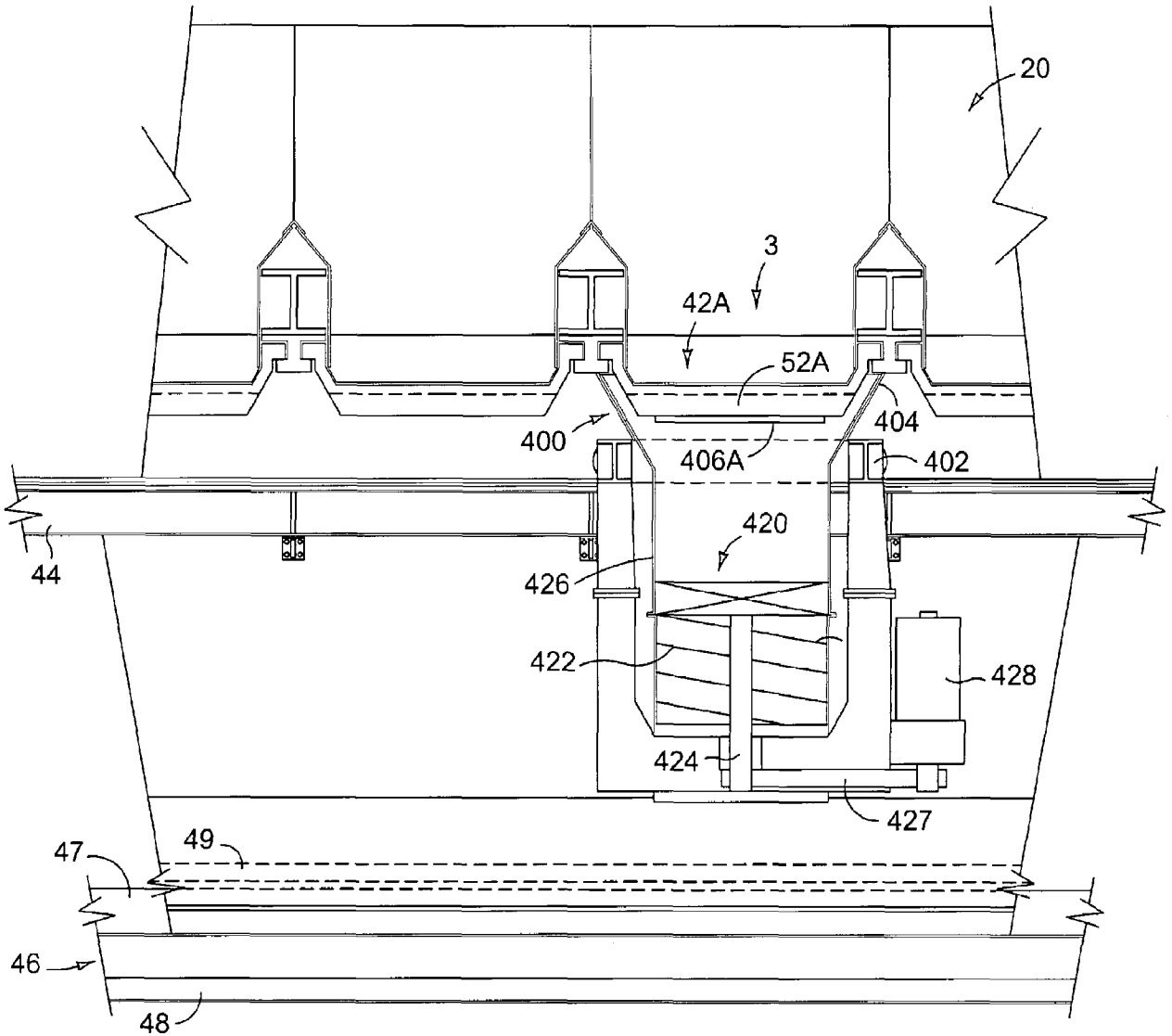
FIG. 9 is another side elevation sectional view similar to FIG. 7, but depicting a single traveling reclaimer as including an auger feeder instead of a metering conveyor.

FIG. 9 is a side elevation sectional view similar to that shown in FIG. 8. FIG. 9 depicts a traveling reclaimer 400 in accordance with yet another embodiment of the present invention. The traveling reclaimer 400 is depicted as being located at gate 42A. Reclaimer 400 includes carriage 402 which is configured to ride on rails 44. A gate engaging member (here, depicted by lower edge of channel section 406A, similar to channel section 106A of FIG. 4B) is configured to engage gate member 52A, thus allowing the traveling reclaimer 400 to selectively open and close gate 42A in the manner described above with respect to FIG. 3B for reclaimer 100. The traveling reclaimer 400 includes a hopper 404 (similar to hopper 104 of FIG. 3D), except that hopper 404 includes a lower extension 426. Located within the lower extension 426 of hopper 404 is a material metering device, which here is depicted as being an auger feeder 420. The auger feeder 420 includes an auger 422 which is supported by shaft 424 in the hopper extension 426. A motor 428 is configured to drive the shaft 424, and thus the auger 422, via a belt or chain drive 427. A gear reduction mechanism (not shown) can be provided between the motor 428 and the shaft 424. Material passing from the lower end of the auger 422 is deposited onto the upper portion 47 of the conveyor belt 46. In general, the rate at which bulk material passes from the storage volume 20 through the opening 3, thence through the (open) gate 42A, and finally onto the upper portion 47 of the conveyor belt 46, will be governed by the rotational speed at which the motor 428 drives the auger 422. Preferably, the motor 428 allows for speed control, such that the rotational speed of the auger 422 can be selectively controlled to thereby control the rate at which bulk material from the storage volume 20 is deposited onto the upper portion 47 of the conveyor belt 46.

Figures 10, 11:
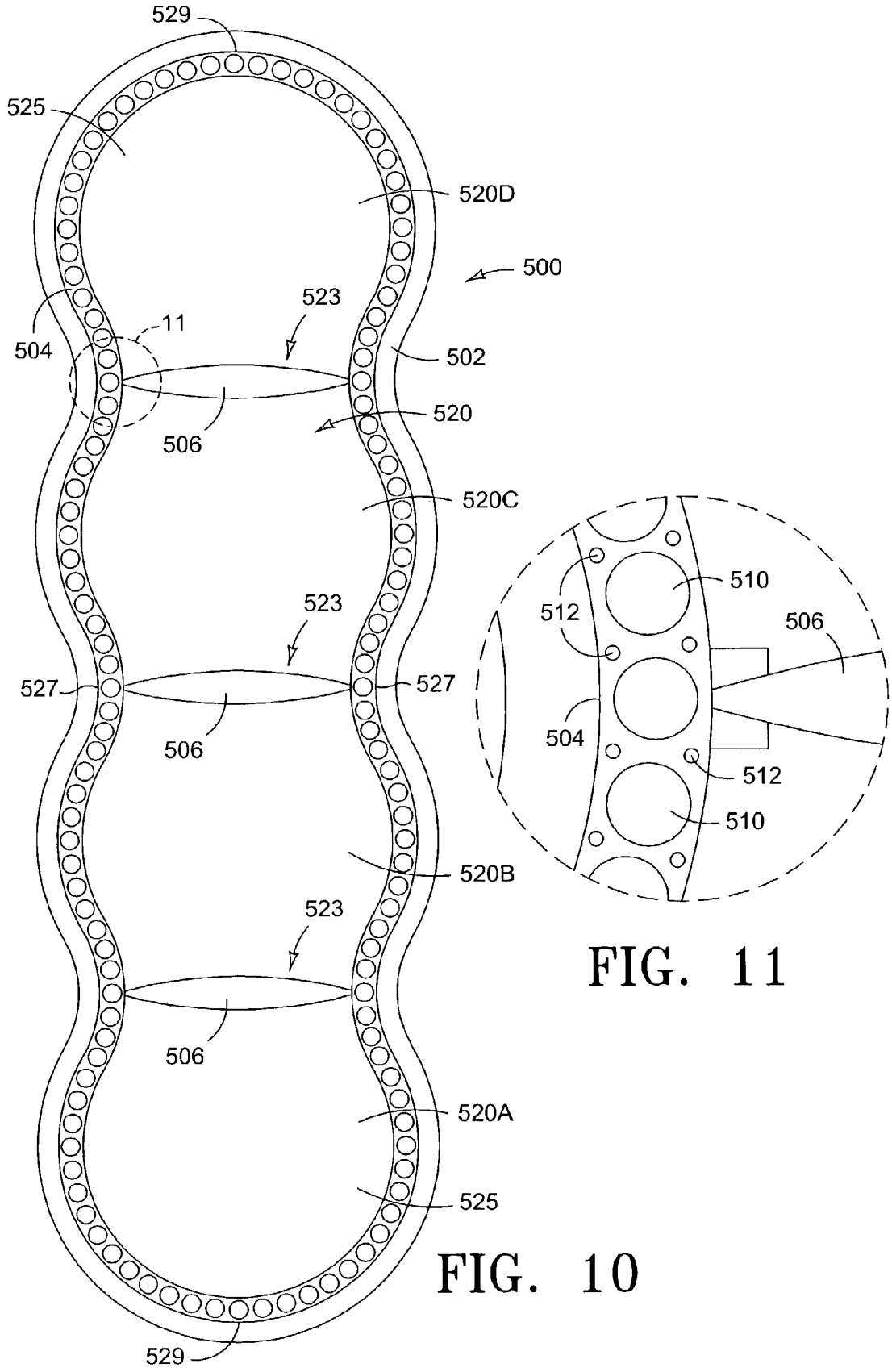
FIG. 10 is a plan sectional view of a bulk storage bin in accordance with yet another embodiment of the present invention.
FIG. 11 is a detail diagram from FIG. 10.

Turning now to FIG. 10, a further embodiment of the present invention provides for a bulk storage bin 500 which includes a foundation 502, and a continuous perimeter wall 504 supported on the foundation. The continuous perimeter wall 504 defines, at least in-part, a storage volume 520. In plan view (as depicted in FIG. 10) the perimeter wall 504 is defined by corrugated sections (i.e., the "undulated" or "sinusoidal-type" curvations depicted). Turning briefly to FIG. 11, a detail of the perimeter wall 504 of FIG. 10 is shown in plan view. As depicted in FIG. 11, the perimeter wall 504 is a honeycomb wall fabricated from concrete and defining generally vertical hollow openings 510 therein. The perimeter wall 504 can also include post-tensioning ducts 512 which are configured to receive post-tensioning tendons (not shown), thereby allowing the wall 504 to be post-tensioned to thusly increase the structural stability of the wall 504. Turning back to FIG. 10, the perimeter wall 504 can be defined by opposing end portions 529 and generally parallel, elongated side portions 527 which are connected to the end portions 529. The corrugated sections of the perimeter wall 504 are generally defined by the side portions 527. The corrugated sections of the perimeter wall (defined in the side portions 527) define narrow sections 523 and wide sections 525 within the storage volume 520. The continuous perimeter wall 504 can be fabricated, for example, using methods and apparatus described in my U.S. patent application Ser. No. 10/131,838, filed Apr. 25, 2002. The bulk storage bin 500 can further include dividing walls 506 (similar to bin dividers 24 of FIG. 2) placed between the corrugated sections (defined in the side portions 527) at the narrow sections 523 to thereby divide the enclosed storage volume 520 into first, second and so-on storage compartments 520A, 520B, 520C and 520D. The continuous perimeter wall 504 can define an upper opening of the storage volume 520 (the upper opening not specifically depicted in FIG. 10, but corresponding to the opening defined by the rectangular inboard solid perimeter line shown in FIG. 2). In this instance, the dividing wall(s) 506 (FIG. 10) can include a plurality of removable wall segments (similar to the removable wall segments 24A through 24J of FIG. 1A) which are configured to be lowered into the storage volume 520 through the upper opening, as for example by a gantry crane similar to gantry crane 28 of FIG. 1A. Further, as described with respect to FIGS. 1A and 2, the bulk storage bin 500 of FIG. 10 can include a stiffening diaphragm (similar to diaphragm 18 of FIGS. 1A and 2) placed at, and attached to, an upper edge of the perimeter wall 504 (e.g., immediately under roof 14 of storage bin 10 of FIG. 1A).

Although bulk storage bins 10 and 500 are depicted herein as having "corrugated" wall members (16 and 504, respectively), it will be appreciated that certain embodiments of the present invention are not limited to use with such bulk storage bins. For example, the embodiment of the invention pertaining to removable bin dividers (dividing walls) (e.g., bin dividers 24 and 506 of respective FIGS. 1A and 10) can be provided with other bulk storage bins having a non-corrugated perimeter wall. Likewise, the traveling reclaimer 100 (and/or 200A, 200B, 300, 400) can be used in conjunction with any type of bulk storage means, and is not limited to use with bulk storage bins such as bin 10 (FIG. 1A) or 500 (FIG. 10). Further, as described previously, the traveling reclaimer (100 and/or 200A, 200B, 300, 400) can be used to open a gate (42, FIG. 3D, for example) to allow bulk material to flow onto a conveyor (46, FIG. 3D), or any other type of material receiving means, such as railroad cars, trucks, or any other material transfer devices or means.

Yet another embodiment of the present invention provides for a material reclaiming apparatus (such as the traveling reclaimer 100 of FIGS. 5 and 6) which is configured to travel along beneath a plurality of gates (42, FIG. 2). The traveling reclaimer includes one or more gate engaging members (e.g., channel sections 106A and/or 106B). When positioned under any given gate, the gate engaging member(s) will automatically (i.e., without any human or supplemental mechanical or electrical intervention) engage the gate to allow the gate engaging members to selectively open and/or close the gate. The traveling reclaimer can include a hopper (e.g., hopper 104 of FIG. 3D) which is configured to guide bulk material passing through the (open) gate onto, or into, a material receiving device (such as conveyor 46 of FIG. 3D, or a railcar, etc.). Although the traveling reclaimer 100 is depicted herein as having two gate actuators (107A, 107B, FIG. 3D) configured to actuate respective first and second gate members (52A, 52B), it will be appreciated that the gate 42 can include a single gate member (e.g., only gate member 52A), in which event only a single gate actuator (e.g. gate actuator 107A) can be provided with the traveling reclaimer 100 to effect opening of the gate 42.

It will also be appreciated that the "foundation" 12 of the bulk storage bin 10 of FIG. 1A (or the "foundation" 502 of bin 500 of FIG. 10) can equally be the bottom of the hull of a ship (such as an ore or grain freighter). Accordingly, yet another embodiment of the present invention provides for a bulk material transport vessel (or ship) which includes a material reclaiming apparatus as described herein (e.g., the traveling reclaimer 100 (FIGS. 3A, 3D, 5 and 6), reclaimers 200A and 200B (FIG. 7), reclaimer 300 (FIG. 8), and reclaimer 400 (FIG. 9)).

A further embodiment of the present invention provides for a method of reclaiming (i.e., recovering) a bulk material from a bulk storage volume defined by a bulk storage means. The method includes providing a plurality of openings from the bulk storage means (e.g., openings 3 (FIG. 3A) from bulk storage bin 10 (FIG. 1A)), providing a gate (e.g., gate 42, FIG. 1A) in each opening, and providing a traveling reclaimer (e.g., reclaimer 100 of FIG. 3D). The method further includes moving the traveling reclaimer into a position under a gate (as depicted in FIGS. 3D and 4B), and opening the gate using the traveling reclaimer, to thereby allow bulk material to flow out of the bulk storage volume through the (opened) gate. The method can further include automatically engaging the gate with a gate engaging member of the traveling reclaimer by positioning the traveling reclaimer under the gate.

I claim:

1. A material reclaiming apparatus for use with a bulk storage means defining a storage volume, the bulk storage means comprising a bottom which further defines the storage volume, the bottom defining an elongated plurality of outlet openings from the storage volume, the material reclaiming apparatus comprising:

a plurality of gates, each gate configured to be associated with a respective outlet opening and moveable from a first position wherein the gate blocks the associated outlet opening, to a second position wherein the gate does not block the associated opening; and a traveling reclaimer configured to be located beneath the bottom and configured to travel in a direction of travel along the bottom beneath the plurality of gates, the traveling reclaimer comprising:

a gate actuator; and a hopper;

and wherein:

as a result of positioning the traveling reclaimer under any given gate, the gate actuator engages the given gate to allow the gate actuator to move the given gate from the first position to the second position;

the gate is moveable from the first position to the second position generally perpendicular to the direction of travel of the traveling reclaimer; and the hopper is configured to be aligned under the given gate and to guide material from the storage volume to a material receiving receptacle when the given gate is in the second position.

2. The material reclaiming apparatus of claim 1, and wherein:

each gate comprises a downward extending flange;

the gate actuator comprises a channel section configured to receive the downward extending flange of the given gate when the traveling reclaimer is positioned beneath the given gate; and the channel section is moveable to urge the flange portion of the given gate, and thereby move the given gate from the first position to the second position.

3. The material reclaiming apparatus of claim 1, and wherein the gate actuator is controllable to selectively control the position of the given gate to the first position, the second position, and intermediate positions between the first position and the second position.

4. The material reclaiming apparatus of claim 1, and wherein the bottom of the bulk storage means comprises a first bottom wall and a second bottom wall, the first bottom wall and the second bottom wall being arranged in parallel, spaced-apart "V" configuration with respect to one another to thereby define the plurality of openings in the bottom, and the bulk storage bin further comprises first and second tunnel walls oriented in parallel, spaced-apart relationship under the respective first and second bottom walls, the material reclaiming apparatus further comprising a first rail and a second rail supported on the respective first and second tunnel walls in parallel, opposed arrangement, and wherein the traveling reclaimer is configured to travel along the rails.

5. The material reclaiming apparatus of claim 1, and further comprising a stationary conveyor located beneath the traveling reclaimer and aligned with the plurality of gates.

6. The material reclaiming apparatus of claim 1, and wherein:

each gate comprises a first gate member and a second gate member, the gate members being arranged in moveable opposed relationship to one another and configured to abut one another to place the gate in the first position, and to move away from one another to place the gate in the second position; and the gate actuator comprises a first engaging member configured to engage and move the first gate member, and a second engaging member configured to engage and move the second gate member.

7. The material reclaiming apparatus of claim 6, and wherein:

the traveling reclaimer is configured to travel in a first direction; and the first and second gate members are configured to move in a direction perpendicular to the first direction.

8. The material reclaiming apparatus of claim 6, and wherein:

each gate member comprises a downward extending flange; and each engaging member comprises a channel section configured to receive the downward extending flange of the respective gate member when the traveling reclaimer is positioned beneath the given gate; and wherein the channel sections are moveable to urge the flange portion of the respective gate member, and thereby move the given gate from the first position to the second position.

9. The material reclaiming apparatus of claim 8, and wherein the traveling reclaimer further comprises:

a carriage which supports the first and second engaging members;

a plurality of wheels supported by the carriage and configured to ride on the first and second rails;

a first hydraulic cylinder configured to move the first engaging member; and a second hydraulic cylinder configured to move the second engaging member.

10. The material reclaiming apparatus of claim 1, and wherein the traveling reclaimer further comprises:

a hopper configured to guide material from the storage volume to a material receiving receptacle when the given gate is in the second position; and a material metering device configured to be positioned under the given gate and to meter the flow of material from the storage volume to a material receiving receptacle when the given gate is in the second position.

11. The material reclaiming apparatus of claim 10, and wherein the material metering device comprises a vibratory pan feeder.

12. The material reclaiming apparatus of claim 10, and wherein the material metering device comprises an auger feeder.

13. A bulk storage bin, comprising:

a foundation;

a continuous perimeter wall supported on the foundation and defining a storage volume; and a sloped bottom attached to the perimeter wall, and wherein:

the sloped bottom further defines the storage volume;

the sloped bottom defines an elongated plurality of outlet openings from the storage volume; and the perimeter wall, the foundation and the sloped bottom define an unloading tunnel;

a plurality of gates, each gate associated with a respective outlet opening and moveable from a first position wherein the gate blocks the associated outlet opening, to a second position wherein the gate does not block the associated opening;

a material receiving device located within the unloading tunnel and beneath the plurality of gates; and a traveling reclaimer located within the unloading tunnel between the plurality of gates and the material receiving device, and configured to travel in a direction of travel along the unloading tunnel under the plurality of gates, the traveling reclaimer comprising:

a gate actuator;

and wherein:

when the traveling reclaimer is positioned under any given gate, the gate actuator is configured to engage the given gate to allow the gate actuator to move the given gate from the first position to the second position; and the gate is moveable from the first position to the second position generally perpendicular to the direction of travel of the traveling reclaimer;

the bulk storage bin further comprising a first rail and a second rail, each rail supported on a respective one of the pair of tunnel walls in parallel, opposed arrangement to one another, and wherein the traveling reclaimer is configured to travel along the rails.

14. The bulk storage bin of claim 13, and wherein the material receiving device comprises a conveyor.

15. The bulk storage bin of claim 13, and wherein:

the sloped bottom of the bulk storage bin comprises a first bottom wall and a second bottom wall, the first bottom wall and the second bottom wall being arranged in parallel, spaced-apart "V" relationship with respect to one another to thereby define the plurality of openings in the sloped bottom; and the bulk storage bin further comprises a pair of parallel, spaced-apart tunnel walls located within the unloading tunnel between the foundation and the respective first and second bottom walls.

16. The bulk storage bin of claim 13, and wherein:

each gate comprises a first gate member and a second gate member, the gate members being arranged in moveable opposed relationship to one another and configured to abut one another to place the gate in the first position, and to move away from one another to place the gate in the second position; and the gate actuator comprises a first engaging member configured to engage and move the first gate member, and a second engaging member configured to engage and move the second gate member.

17. The bulk storage bin of claim 16, and wherein:

each gate member comprises a downward extending flange; and each engaging member comprises a channel section configured to receive the downward extending flange of the respective gate member when the traveling reclaimer is positioned beneath the given gate; and wherein the channel sections are moveable to urge the flange portion of the respective gate member and thereby move the given gate from the first position to the second position.

18. The bulk storage bin of claim 13, and wherein the traveling reclaimer is a first traveling reclaimer and the gate actuator is a first reclaimer gate actuator, the bulk storage bin further comprising a second traveling reclaimer located within the unloading tunnel between the plurality of gates and the material receiving device, and configured to travel along the unloading tunnel under the plurality of gates, the second traveling reclaimer comprising a second reclaimer gate actuator, and wherein when the second traveling reclaimer is positioned under any given gate, the second reclaimer gate actuator is configured to engage the given gate to allow the second reclaimer gate actuator to move the given gate from the first position to the second position.

* * * * *